US009725957B2

(12) United States Patent
Herrick et al.

(10) Patent No.: US 9,725,957 B2
(45) **Date of Patent: *Aug. 8, 2017**

(54) HAND-PORTABLE DIRECTIONAL DRILL AND METHOD OF USE

(71) Applicant: RODDIE, INC., Columbia Falls, MT (US)

(72) Inventors: Rod Herrick, Whitefish, MT (US); Jared W Shappell, Kalispell, MT (US)

(73) Assignee: RODDIE, INC., Columbia Falls, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/981,397

(22) Filed: Dec. 28, 2015

(65) Prior Publication Data

US 2017/0183911 A1 Jun. 29, 2017

(51) Int. Cl.

| | |
|---|---|
| ***E21B 11/00*** | (2006.01) |
| ***E21B 7/02*** | (2006.01) |
| ***E21B 7/04*** | (2006.01) |
| ***E21B 3/04*** | (2006.01) |
| ***E21B 10/60*** | (2006.01) |

(52) U.S. Cl.

CPC ..... *E21B 7/022* (2013.01); *E21B 3/04* (2013.01); *E21B 7/046* (2013.01); *E21B 10/60* (2013.01); *E21B 11/005* (2013.01)

(58) Field of Classification Search

USPC ..... 173/34

See application file for complete search history.

(56) References Cited

U.S. PATENT DOCUMENTS

| | | | | |
|---|---|---|---|---|
| 3,554,298 | A | 1/1971 | Klein | |
| 5,205,671 | A | 4/1993 | Handford | |
| 6,109,831 | A | 8/2000 | Handford | |
| 6,202,758 | B1 * | 3/2001 | Jenne | E21B 19/081 173/141 |
| 7,478,685 | B2 * | 1/2009 | Ferrand | E21B 7/022 173/185 |

FOREIGN PATENT DOCUMENTS

| | | | |
|---|---|---|---|
| EP | 0904461 | B1 | 8/2006 |
| WO | 2013/055389 | A1 | 8/2013 |

OTHER PUBLICATIONS

Mclaughlin Pit Launch Directional Drill http://www.mclaughlinunderground.com/wp-content/uploads/2013/08/McL-10-Lit.pdf.*

Bor-it Model 12 "Mighty Max" http://www.bor-it.com/resources/pdfs/12.pdf.*

Grundopit 40/60 Mini-Directional Drill—marketing brochure by TT Technologies, Inc.,2020 E New York Street, Aurora, IL 60502, dated 2005.

U.S. Appl. No. 14/163,322, filed Jan. 24, 2014, Herrick.

* cited by examiner

*Primary Examiner* — Kyle Armstrong

(74) *Attorney, Agent, or Firm* — Robin Kelson Consulting

(57) ABSTRACT

Provided are single and multi-stage hand-portable directional drilling devices designed to drill through space underground, particularly for drilling channels underground from within an interior building space. Also provided are improvements in a drill head providing means for removing or preventing clogging of a drill tip lubricant channel or fluid hole.

15 Claims, 23 Drawing Sheets

HAND-PORTABLE DIRECTIONAL DRILL AND METHOD OF USE

FIELD OF USE

Embodiments of the present disclosure find applicability in the field of directional drill systems designed to drill through space underground. One useful field includes systems for drilling channels underground for laying gas, water, sewer or other underground pipes.

BACKGROUND

Directional drilling machines and methods of use are well-known and well-characterized in the art. Also referred to in the art as boring, thrusting or horizontal drilling, the technology allows for the laying of pipe and cable underground (e.g., gas, water, sewer and drain pipes; ducts; power cables, and the like) without needing to excavate or cut open the ground surface along the length of the pipe or cable to be installed. Typically, the process is executed by boring into the ground at an angle to a desired depth, then changing to a horizontal drilling direction. The drill gains its directional ability by means of an angled steering blade in the drill head behind which is a transmitter or locater beacon (e.g., "sonde" or GPS locator) that relays information to an above-ground operator so that drilling height and direction can be manipulated remotely to avoid obstacles and arrive at an intended location. Directional boring machines are generally configured to drive a series of drill rods joined end-to-end to form a drill string. At the drilling destination, an access pit is provided. When the drill head penetrates the access pit wall, the drill head is removed, and a pipe cable is attached to the drill string, optionally behind a rotating reamer head that serves to enlarge the bore as the pipe or cable is being pulled back through the bore by the retracting drill string. Once the pipe or cable is pulled through the bore and is laid, it is connected as desired to the service source and service receiver. Patent publications U.S. Pat. No. 6,109,831; U.S. Pat. No. 5,205,671; U.S. Pat. No. 3,554,298; EP 0 904 461; and WO 2013/055389 are representative of the art.

In the case where directional drilling is desired to deliver cable or pipe to a building basement, currently it is necessary to build an access pit outside the building, adjacent the building basement wall and to a depth where the pipe or cable will be delivered to the building. A hole is then drilled through the basement wall and the pipe or cable passed through this opening. Building access pits outside and adjacent building basements are unattractive and can be difficult to carry out, due to intervening topography or structures. It would be preferable to launch directional drilling from the basement interior itself, and excavate the access or destination pit out at the street or service source, away from building structures. However, current directional drilling machines are large, heavy and cumbersome. Typically, the machines are delivered to their location by trailer, and maneuvered into position on tracks or rollers. For example, the Grundopit 40/60 by TT Technologies, Inc., considered a mini-directional drill suitable for pit launched drilling, weighs over 400 pounds. There remains a need for a hand-portable, lightweight mini-directional drill that can be hand-carried into buildings, and has dimensions that accommodate transport up and down stairwells and around building interior corners.

SUMMARY

This summary is provided to introduce a selection of concepts in a simplified form that are further described below in the Detailed Description. This summary is not intended to identify key features of the claimed subject matter on its own, nor is it intended to be used alone as an aid in determining the scope of the claimed subject matter.

In accordance with one embodiment of the present disclosure, a hand-portable directional drill device is provided. In one preferred embodiment, the drill weighs less than about 200 pounds. In another preferred embodiment, the drill weighs less than about 190 pounds. In still another preferred embodiment, the drill is competent to deliver a drill string underground at least about 200 feet. In still another preferred embodiment, the drill is competent to deliver a drill string underground at least about 250 feet. In another preferred embodiment, the hand-portable directional drill device can be used both in an exterior, pit-launched application and it can be attached to an interior basement wall in an interior, building-launched application. In still another preferred embodiment, the drill comprises two components that can be disengaged from one another for carrying purposes, each component weighing less than about 100 pounds. In another embodiment, the device can accommodate pipe stems of varying lengths, and has thrust and pull back strengths of at least about 4,000 pounds each.

In one embodiment, the two-component hand-portable direction drill comprises (1) a chassis component comprising a wall-mountable chassis or frame that consists substantially of a longitudinal beam attached at one end to a wall mount plate, and (2) a rotary drive or "carriage" component comprising a hydraulically powered rotary drive unit and a hydraulically powered directional drive unit. In another embodiment, the drive component comprises a hydraulic valving system, a hydraulically powered rod or stem pipe spinning assembly, a hydraulically powered means for moving the drive component along the chassis, and means for coupling the drive component with the chassis component.

In one embodiment, the hand-portable directional drill comprises a two-stage system for moving the rotary drive component along the chassis length. In another embodiment, the hand-portable directional drill comprises a one-stage system for moving the rotary drive component along the chassis length.

In one embodiment, the hydraulically powered means for moving the rotary drive component along the chassis beam is positioned lateral to the chassis beam's longitudinal axis. In another embodiment, the hydraulically powered means for moving the main body along the chassis beam is positioned over or under the chassis beam. In still another embodiment, the chassis beam comprises two parallel, opposing sections and the hydraulically powered means for moving the rotary drive component along the chassis beam is positioned between the two parallel beam sections.

In one embodiment, the hydraulically powered means for moving the rotary drive component along the chassis beam's length comprises a screw. In still another embodiment, the hydraulically powered means for moving the rotary drive along the chassis beam's length comprises a roller chain drive.

In still another embodiment, the coupling means that couples the rotary drive component to the chassis component allows the rotary drive component to slide or otherwise travel along the longitudinal axis of the chassis beam when coupled to it. In one embodiment, the coupling means comprises a collar extending out from the main body and dimensioned to substantially surround the longitudinal beam and slide along its longitudinal axis. In another embodiment, the coupling means comprises a channel or slot along the chassis beam's longitudinal axis and a projection, tongue or key extending out from the rotary drive component, dimensioned to fit in the channel and allow the rotary drive component to travel along the channel's path, moving the rotary drive component with it along the beam's longitudinal axis.

In one embodiment, the hydraulically powered means for moving the rotary drive component along the chassis beam's length comprises a screw. In still another embodiment, the hydraulically powered means for moving the rotary drive component along the chassis beam's length comprises a roller chain.

In accordance with another embodiment of the present disclosure, a single or multi-staging hand-portable mini-directional drill is provided that can be hand-carried up and down stairs easily and maneuvered around tight spaces. In accordance with another embodiment of the present disclosure, a wall-mountable directional drilling device is provided. In still another embodiment of the present disclosure, the hand-portable directional drill of the present disclosure can be used either as a wall mountable device for use inside a building, or as a pit-launched device for use outside a building.

In accordance with another embodiment of the present disclosure, a hand-portable directional drill competent to drill drill stem sections of variable length is provided. In another embodiment, the hand-portable directional drill disclosed herein is competent to drill 24-inch and 1-meter drill stem sections. In another embodiment the hand-portable directional drill detaches into two hand-portable components. In still another embodiment each component weighs less than about 100 pounds. In another preferred embodiment, each component weighs less than about 90 pounds. In still another embodiment, the intact hand-portable directional drilling device of the present disclosure weighs less than about 200 pounds.

In still another embodiment a drill head having an improved lubricant delivery mechanism is provided.

In accordance with another aspect of the present disclosure, a method for directional drilling from inside a building is provided, as is a method for directional drilling using a hand-portable, wall-mountable directional drill, including a single-stage hand-portable directional drill.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Embodiments of the present disclosure provide devices and methods for directional drilling in confined spaces, and more particularly for directional drilling from within a building interior, including a basement space. Also provided are devices and methods for using an improved directional valving unit and an improved drill head and lubricant delivery system.

Key features of the hand-portable directional drill system disclosed herein are its low weight and small dimensions, its ability to deliver a drill string up to at least about 200-250 feet underground with average thrust and pull back strengths of at least about 4,000 pounds each, and its ability to be hand-carried intact or in its constituent components for easy delivery and set-up in small interior building spaces. The hand-portable directional drill system disclosed herein works by powering a compact, lightweight, detachable rotary drive component to move along the longitudinal axis of a chassis component and to which the rotary drive component can be removably coupled. The rotary drive can be moved along the chassis in a single stage or multi-stage process. A two-stage hand-portable directional drill system is described in detail in U.S. Ser. No. 14/163,322, filed Jan. 24, 2014, the disclosure of which is expressly incorporated herein by reference. As disclosed therein, the rotary drive component travels along the chassis length by means of a hydraulic cylinder piston rod and barrel. Described hereinbelow, are multiple embodiments for moving the rotary drive component along the chassis' length as part of a single stage system. It will be understood by those skilled in the art that a hydraulic cylinder piston rod and barrel also could be used in a single stage system as described herein.

I. Roller Chain-Driven Hand-Portable Directional Drill System

Figure 1A:
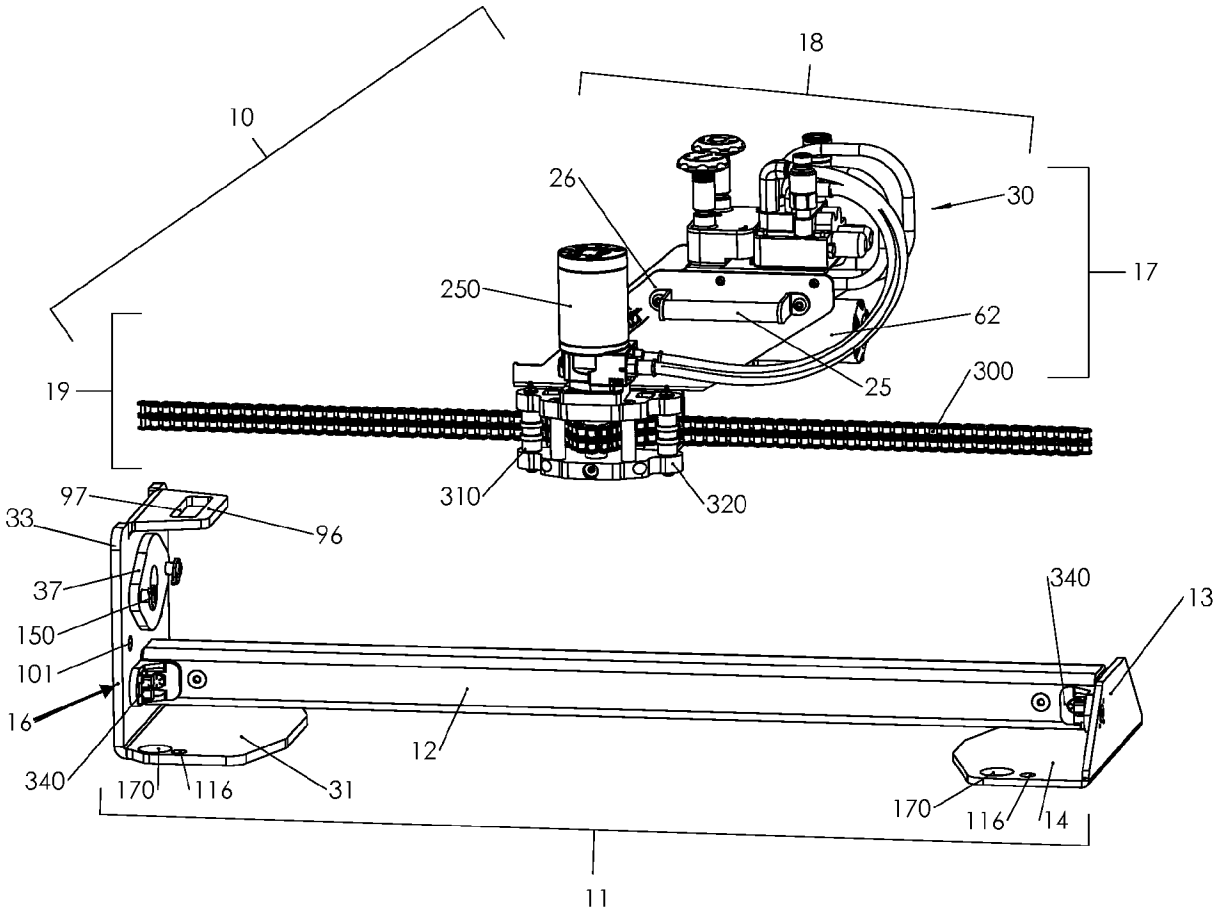
FIGS. 1A-1C illustrate two perspectives of a single-stage hand-portable directional drill device in accordance with one embodiment of this disclosure, in both its its uncoupled carrying form (FIG. 1A) and its coupled operational form (FIGS. 1B, 1C)
Figure 1B:
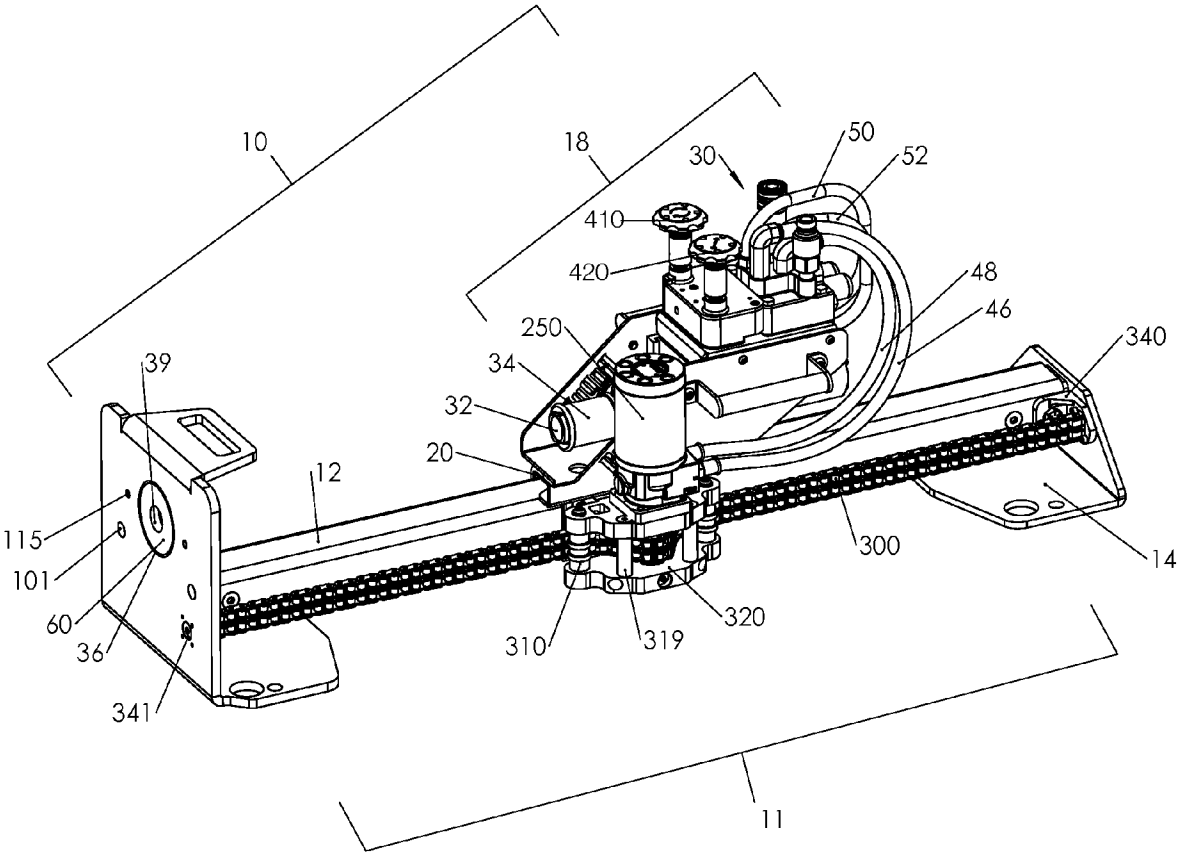
Figure 1C:
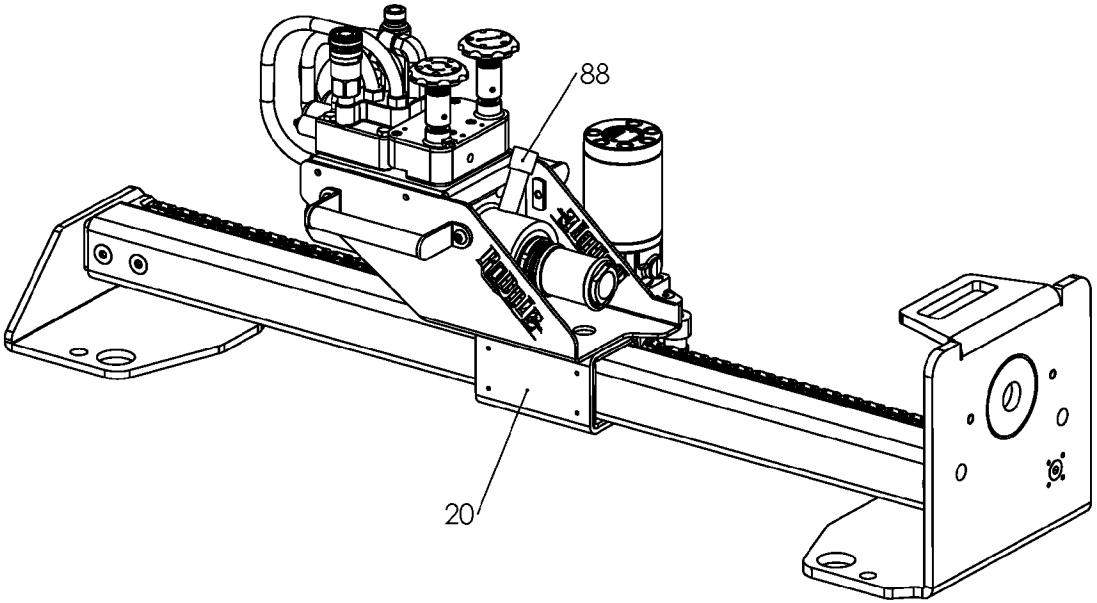
Figure 6A:
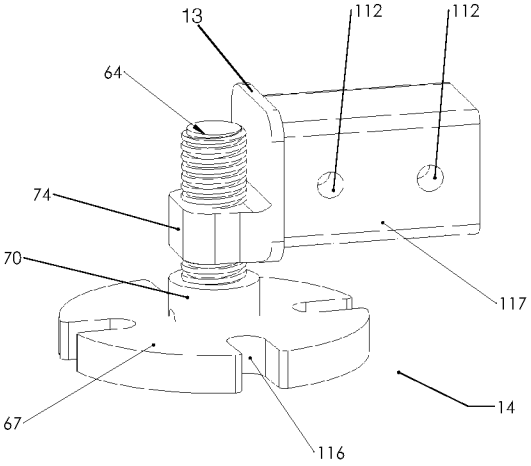
FIGS. 6A and 6B illustrate two embodiments of a hand-portable directional drill in accordance with this disclosure for use in (4A) an interior space, and (4B) a pit-launch application.
Figure 6B:
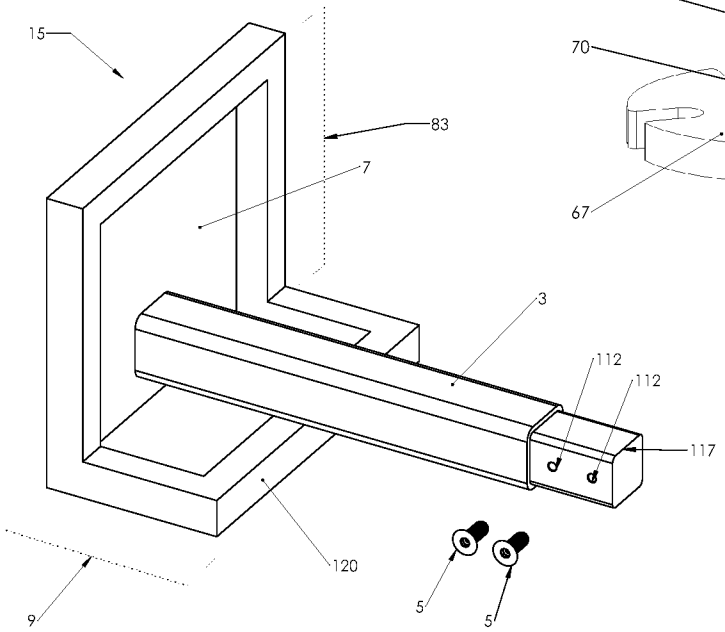

Referring now to FIGS. 1A-1C, one embodiment of the hand-portable directional drilling device 10 in accordance with the present disclosure is shown. The device 10 comprises two detachable components. The first component, referred to herein as the chassis component 11, comprises a longitudinal frame or beam, referred to herein as chassis 12 having at its front or anterior end a plate 16 adapted for mounting on a wall, typically a concrete wall, and a removable foot plate 14 at its back or posterior end. The foot plate depicted in the figures is a removable fixed plate. In another embodiment, illustrated in FIG. 6A below, the footplate can be height adjustable. In still another embodiment, illustrated in FIG. 6B below, the foot plate 14 can be replaced with a pit launch back plate 15 and the hand-portable directional drills disclosed here can be used for a pit-launched directional drilling application.

The second component 18, referred to herein as "carriage component 18" and/or "rotary drive component 18", comprises a combined power and rotary drive unit 17 for attaching stem pipe sections to form a drill string and drilling the string along an intended path underground. Typically, combined power and rotary drive units 17 comprise a hydraulic valving system 30, rotary drive unit, with hydraulic motor for driving a stem pipe spinning assembly, described in detail with reference to FIGS. 7 and 10, below. Hydraulic valving unit 30 also can provide power to directional drive component 19, as described below, Component 18 further can comprise a slidable carriage 20. Carriage 20 provides means for coupling combined power and rotary drive unit 17 to chassis component 11, such that unit 17 can travel along chassis beam 12 on demand. In the embodiment illustrated in FIGS. 1A-1C, carriage 20 comprises a cuff dimensioned to fit over chassis 12 and slide along its length, typically driven by a hydraulically powered drive means. It will be appreciated by those skilled in the art that other, functionally equivalent coupling means are within the skill of the art to fabricate without undue experimentation, provided with the instant disclosure. Other useful coupling means can include, without limitation, a tongue-and-groove coupling mechanism, where carriage 20 includes a tongue or key projection of a any shape that fits in a channel or groove in chassis beam 12. In addition, positioning of carriage 20 relative to beam 12 also can be varied. In FIGS. 1A-1C, component 18 is positioned lateral to beam 12. As described in detail in FIG. 16 below, component 18 also can be positioned over beam 12.

Figure 5:
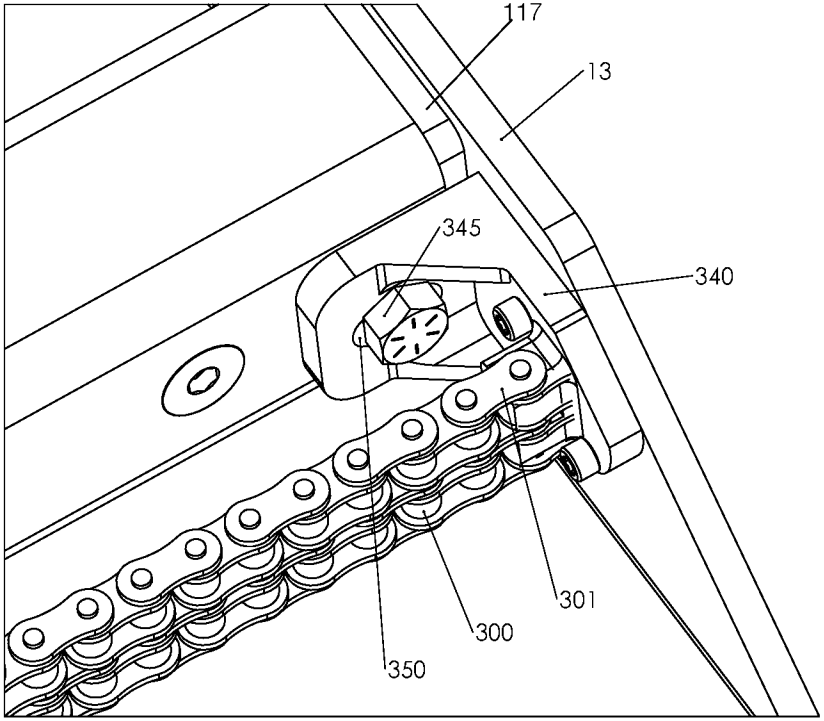
FIG. 5 illustrates a roller chain bolt mechanism n accordance with one embodiment of the present disclosure.

Hydraulically powered directional drive means 19 moves component 18 along chassis beam 12 upon demand, when component 18 is coupled to chassis beam 12. Preferably, directional drive means 19 is substantially corrosion-resistant, impervious to dirt and debris associated with drilling operations, and provides high thrust and pullback strengths. In the embodiment depicted in FIGS. 1A-1C, the hydraulically powered directional drive means 19 can comprise a roller chain drive 300, housing 320 with chain rollers 310, and hydraulic motor 250. Roller chains can be fabricated of high tensile alloys, including stainless steel and other corrosion-resistant metals. Chain drive 300 can be attached to chassis component 11 by means of standard master links and a chain drive bolt 340, as seen in FIG. 5, described in detailed below. A hydraulically powered directional drive means 19 comprising a screw drive is described below and in FIGS. 13-16.

Valving system 30, illustrated in more detail in FIG. 7 and described below, can provide power to roller chain drive motor 250, rotating a sprocket that engages chain 300, moving carriage component 18 forward or back along the chain on command from valving unit 30. FIG. 1C shows hand-portable directional drill 10 from the left perspective, depicting one embodiment of carriage 20 on chassis beam 12.

Figure 2:
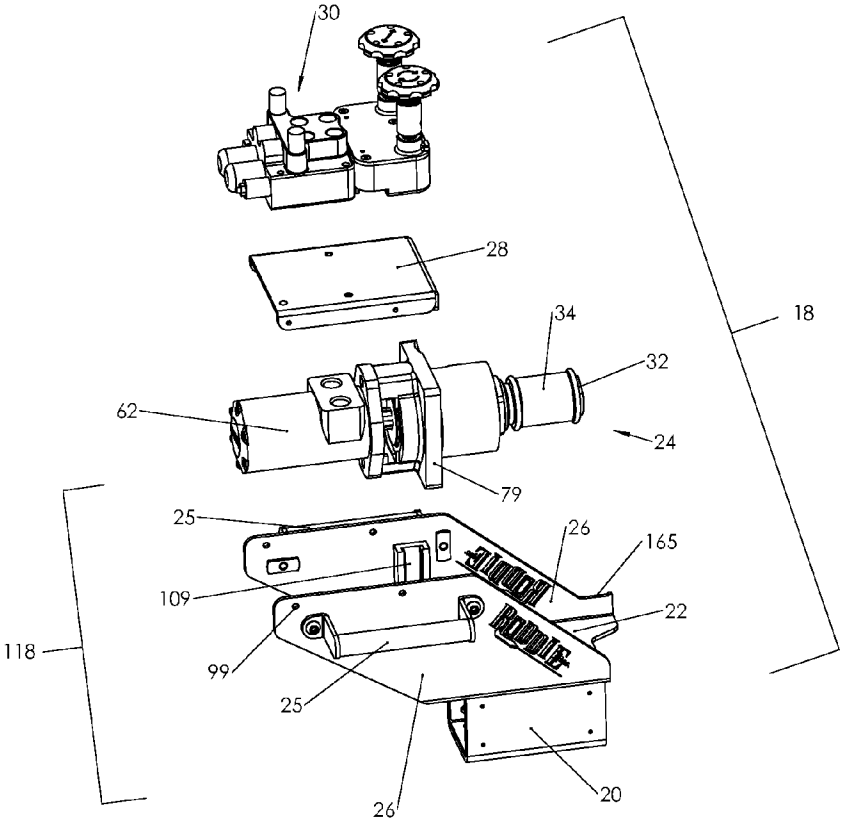
FIG. 2 is an exploded view of a hydraulically powered rotary drive unit component in accordance with one embodiment of the present disclosure.

FIG. 2 is an exploded view of carriage component 18 without carriage drive component 19 (e.g., roller chain drive component in FIG. 1), and illustrates one embodiment for arranging and attaching the member components described hereinbelow. In the example, carriage 20 is integrally attached to a frame 118 to which rotary drive unit 24 and valving unit 30 are attached. Frame 118 provides means for securing rotary drive unit 24 and valving unit 30 to carriage 20 in a compact, lightweight configuration that does not compromise functionality of these units during operation. As illustrated here, valving unit 30 can be stacked over rotary drive unit 24, and both can be supported and held by frame 118. Accordingly, frame 118 can comprise a floor 22 and, optionally, opposing parallel side walls or braces 26 that extend up from frame floor 22. Braces 26 and floor 22 together can define a container that houses rotary drive 24. Braces 26 also can provide attachment means for securing valving unit 30, for example by means of platform 28, and to which valving unit 30 can be bolted. The braces or side walls 26 can be of a solid material as illustrated here or they can define a structural frame with openings, the frame being of sufficient tensile strength to secure and hold both rotary drive unit 24 and hydraulic valving unit 30 and, preferably, provide carrying means for transporting drive component 18, for example, by means of handles 25.

In devices useful according to the present disclosure, multiple means for securing rotary drive unit 24 in carriage component 18 are contemplated. In one embodiment illustrated here, rotary drive unit 24 can comprise a frame component 79 that can slide into sleeves 109 extending vertically from floor 22 and attached to the inside of side braces 26. It will be appreciated by those skilled in the art that sleeves 109 also can comprise part of an open frame structure. Other useful means for stabilizing rotary drive unit 24 to frame 118 can include corner braces, crossbars that span braces 26, or other means for anchoring and seating rotary drive unit 24. In addition, the vertical edges of braces 26 and floor 22 can be angled or otherwise configured, contoured or cut to minimize weight and maximize functionality and ease of access to drill stem adapter 32 and wrench collar 34. For example, lip 165 on brace 26 can be contoured to serve as an auxiliary wrench stop for cracking or breaking open a stem joint as described in more detail below.

Valving unit 30 can be secured to frame 26 by, for example, platform 28, attached to side braces 26, for example by bolting means fitting in bolt holes 99, such that platform 28 sits above unit 24 and provides a floor to which hydraulic valving unit 30 can be secured. Those of ordinary skill in the art will appreciate that platform 28 can comprise a single piece of material, as illustrated here, or a structural frame or brace that lies parallel to, and spans the distance between, opposing side walls 26 and attaches to them by standard attachment means. Substantially stacking slidable carriage 20, rotary drive unit 24, and hydraulic valving unit 30 supports reducing the overall dimensions of the hand-portable directional drilling device of the present disclosure.

Figure 3:
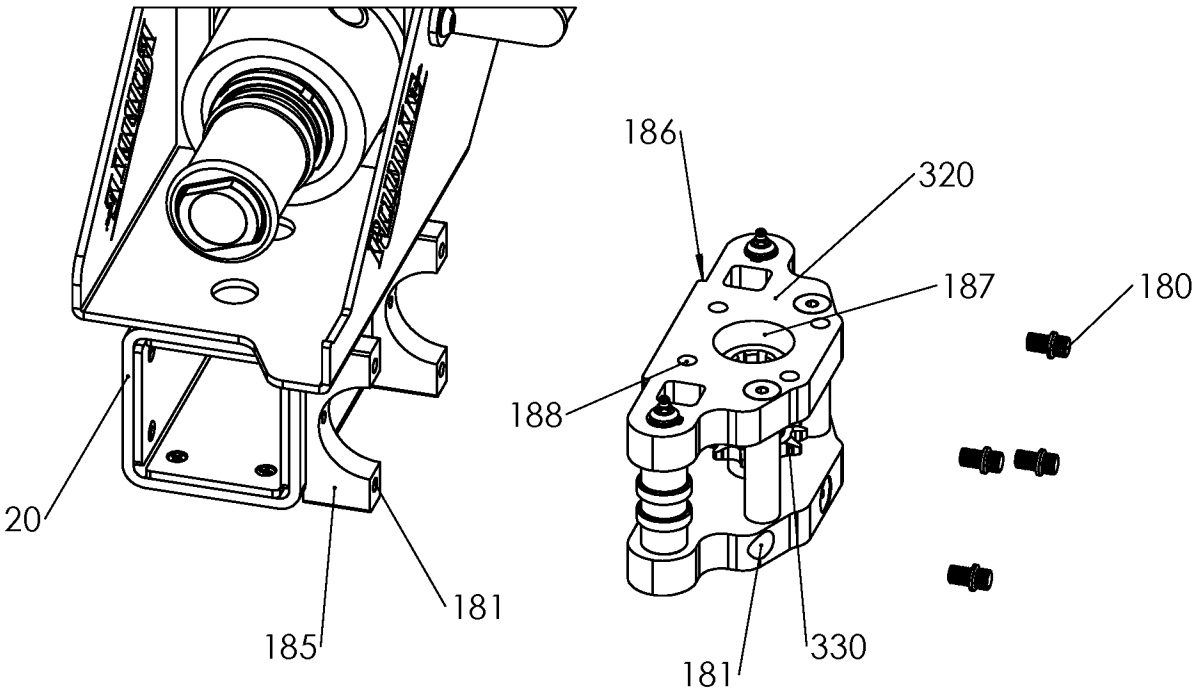
FIG. 3 is an exploded view of a roller chain component and drill carriage coupling according to one embodiment of the present disclosure.

FIG. 3 illustrates an example of how drive roller chain component 19 can be attached to carriage 20. As illustrated in the figure, roller chain drive housing 320 can be bolted carriage 20 by bolting means 180 passing through bolts holes 181. Carriage 20 and/or housing 320 also can comprise extensions of varying shapes and sizes to further brace housing 320 against carriage 20 and/or to provide spacing between the two. Examples of such extensions are illustrated in the figure by brackets 185 on carriage 20 and lip or step 186 on housing 320. In the figure, bolt holes 188 provides for bolting hydraulic drive motor 250 to housing 320 such that the motor's spline shaft passes through opening 187 to connect with roller chain sprocket 330 (see below).

The hand-portable directional drills of the present disclosure preferably have a working or tensile strength (thrust and pull-back) in the range of at least about 4,000 pounds. Selection of a useful roller chain preferably accommodates this working strength and has a breaking strength in the range of at least about 12,000-14,000 pounds. Where maximizing tensile strength is to be balanced with minimizing overall drill weight and size, a double chain comprising a standard ASME roller chain size ranging from 40-60, can be used to advantage, with size 50 (50-2), or a roller chain having a roller diameter in the range of at least about 0.400 inches, being currently preferred. Alternatively, a single roller chain (or other multiple of roller chains) having proper tensile and breaking strength also could be used to advantage. It is within the skill of the art to select roller chains of appropriate tensile and breaking strength for a drill having a specified thrust and pull back strength.

Figure 4A:
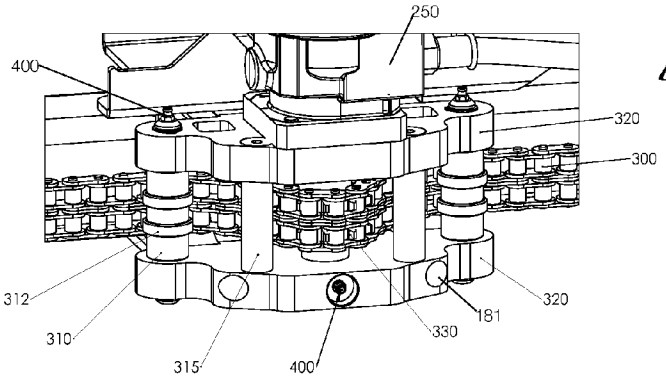
FIGS. 4A-4C depict three views of a roller chain and sprocket mechanism in accordance with one embodiment of the present disclosure.
Figure 4B:
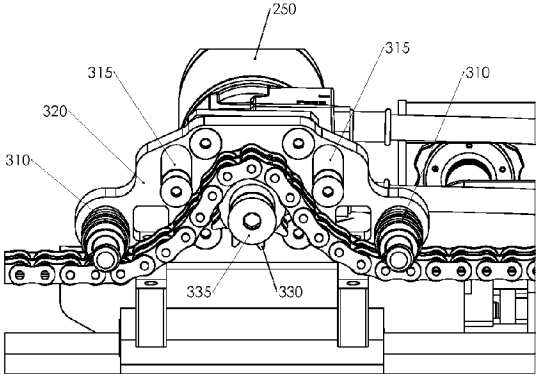
Figure 4C:
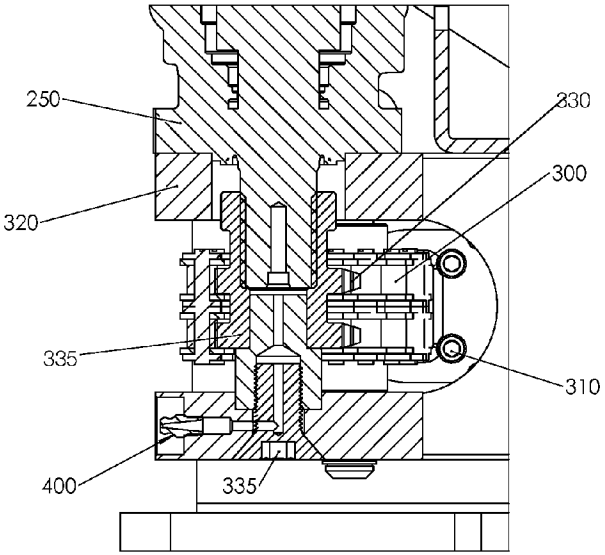

FIGS. 4A-4C depict three views of a roller chain drive mechanism useful in the hand-portable directional drills of the present disclosure. FIG. 4A is a lateral view, FIG. 4B is a view from below, and FIG. 4C is a cross-section of the mechanism and housing 320. With reference also to FIG. 3, in the drawings a roller chain housing 320 houses a vertically positioned sprocket 335 having appropriate teeth positioning to engage roller chain 300. Housing 320 also can include roller bars 310 with ribs 312 positioned to contact the chain rollers and keep the chain in position so the sprocket teeth 330 can engage the chain links as the sprocket and housing travel along the chain. Housing 320 further can include vertical supports 315 and one or more grease zerks 400. The roller chain can be powered by roller chain hydraulic motor 250 which can be mounted vertically over housing 320 such that the motor spline that engages roller chain sprocket 330 passes through an opening 187 in housing 320 to engage the sprocket. During operation, hydraulic fluid entering the appropriate valve line to motor 250 turns sprocket 335 clockwise or counter-clockwise, as desired, and sprocket teeth 330, engaging the links of roller chain 300 as sprocket 335 turns, pulls the housing and attached carriage and rotary drive component forward or back along the chain, as desired.

It is within the skill of the art to select an effective sprocket size for a given roller chain size. Where the selected roller chain size is 50, for example, a useful sprocket can comprise nine teeth and have a pitch within the range of about 0.5 to 1-inch (No. 50-80), with a 0.75-inch pitch (No. 60) being currently preferred. Similarly, it is within the skill of the art to select a hydraulic motor to provide the desired speed and power. Useful directional drive motors can provide a carriage speed in the range of about 10 ft/min and thrust and pullback in the range of about 4,000 pounds. One type of hydraulic motor that can be used to advantage is a gerotor or positive displacement pump. Reductions in speed and power can be managed by a valving unit as described hereinbelow. Flow restrictors in one or more valve lines also can be used to manage speed or power.

Roller chains useful in the directional drills of the present disclosure can be attached to chassis component 11 by any standard means. Referring to FIGS. 1A, 1B and 5, one embodiment of a useful attachment means is illustrated. In the figures, roller chain 300 is attached the directional drill front plate 16 and back plate 13 by means of bolt plate 340 and bolting means 341. Preferably, roller chain 300 is connected to bolt plate 340 by means of a master link as terminal link 301. In a preferred embodiment, bolt plate 340 can be adjustable to accommodate variation in roller chain tension. Adjusting the position of bolt plate 340 can allow the roller chain tension to be loosened or tightened without requiring modification of the chain link size or number. For example, bolt plate 340 can comprise an adjustment bolt 345 and laterally slotted or extended bolt opening 350 that is substantially wider than adjustment bolt 345 such that the position of bolt plate 340 can be moved forward or backward to a degree, decreasing or increasing tension as desired. In addition, washers or spacers can be added to the bolt plate's bolting means, including bolting means 341, to provide additional tension refinement.

FIGS. 1A-1C, 3 and 4A-4B illustrate various embodiments of a hand-portable directional drilling device of the present disclosure. The figures provide an expanded view of the back or posterior end of chassis component 11. FIG. 4A illustrates one embodiment useful for drilling from within a building interior and illustrates a floor plate removably attached to the back end of chassis 12. Floor plate 14 comprises a flat plate 67, a collar 70 extending vertically from plate 68 and located substantially in the center of plate 68, and a threaded pin or bolt 72 extending vertically from collar 70. Pin 72 threads into bolt 74, integral to and extending back from chassis extension sleeve or tailstock 117. Tailstock 117 has an outer diameter that is smaller than the inner diameter of chassis 12, such that tailstock or sleeve 117 can slide into the back end of chassis 12 and be bolted thereto by, for example, supplying bolts to bolt holes 112. Floor plate 14 can serve to brace and stabilize the back end of chassis 12 and optionally can include one or more notches or bolt holes 116 in the perimeter of plate 67 through which concrete bolts can be drilled to further anchor and stabilize floor plate 14. The threaded nut and bolt can allow floor plate 14 to raise and lower the height of the chassis 12 as desired so that directional drill 10 can be made level for efficient drilling. The floor plate assembly disclosed herein also can provide a means for allowing floor plate 14 to be removed easily from chassis 12 for assembly and disassembly of chassis component 11 and combined power/drive component 18. Other means are within the skill of the art to fabricate in view of the present disclosure.

An alternative rear floor plate embodiment is depicted in FIGS. 1A-1C and FIG. 3. Here rear floor plate 14 is integral to back plate 13, creating a fixed "foot" that can be anchored to the floor by bolt means 116. Rear plate 13 also preferably can comprise a tailstock 113 providing means for bolting plate 13 to chassis 12 and also for providing means of modulating the overall length of chassis component 11.

FIG. 4B illustrates an embodiment useful for drilling from an exterior pit. Here the back end of chassis 12 can be removably attached to an extension sleeve or tailstock 117 by means of bolts 5 in bolt holes 112 as described above for floor plate 14 in FIG. 4A. Extending back from sleeve 117 is a chassis extension 3, whose distal end can be integrally attached to a pit wall brace 15 by attaching to a metal plate 7. Brace 15 can comprise a floor section 9 and, perpendicular thereto and extending up therefrom, a wall portion 83. Where the directional drilling device of the present disclosure is used for a pit launch application the back pit wall brace 15 can be subject to significant repetitive force in the drilling process and preferably is constructed to accommodate these forces. The brace in FIG. 4B does so by comprising an outer frame 120 that helps absorb the drilling forces, and to which metal plate 7 is integrally attached. Other means are within the skill of the art to fabricate in view of the present disclosure. Also as will be appreciated by those having ordinary skill in the art, extension 3 can be either of a predetermined length or configured to be extensible from chassis 12.

Referring to FIGS. 1A and 1B wall mount plates useful in the hand-portable directional drilling devices of the present disclosure are illustrated. A more detailed description of useful wall mount plates and wiper assemblies also can be found in U.S. Ser. No. 14/163,322, disclosed by reference hereinabove. In the figures, the wall mount plate 16 can comprise a floor plate 31 and, perpendicular to, and joined to floor plate 31, a vertical wall plate 33. Plates 31 and 33 together define a 90° angle that can be placed flush against the intersection of a building's interior underground wall and floor, such as a basement wall and floor. Preferred wall mount dimensions can vary, provided the wall mount can support forces in the range of at least about two tons.

Floor plate 31 can provide stability for the drill during operation and can be optional. Floor plate 31 further can include one or more bolting means 116 on its perimeter to attach the plate surface to the building floor, for example by means of concrete bolts 35. Floor plate 31 also can comprise stake openings 170 for anchoring the plate to the ground in a pit-launched application. Vertical plate 33 also preferably is attached to the wall by suitable bolting means that attach through bolt holes 101. Drill bit hole or aperture 36 is dimensioned to allow both a drill bit head and a drill stem section to pass through it. Useful drill bit apertures diameters can be in the range of about 3.0-4.0 inches, typically in the range of about 3.5 inches. As will be appreciated by those having ordinary skill in the art, useful aperture dimensions will depend on the size bore hole desired. When wall mount 16 is attached to the wall, chassis component 11 effectively can function as a cantilever, supporting carriage component 18, and can itself be supported by means of a foot plate, described in FIG. 4A below.

A flexible wiper assembly 37 also can be attached to the wall mount by any useful means, including hitch pins 150. Typically, flexible wiper assembly 37 is attached to wall mount 16 once a drill string has been drilled to its destination and the drill string is about to be retrieved. The wiper typically comprises a flexibly stiff material 60, composed of, for example, rubber or silicon. Material 60 has an opening 39 with a diameter smaller than drill bit hole 36. Opening 39 also is dimensioned to be smaller than the outer diameter of a stem pipe such that it provides a snug fit over the pipe surface. When a drill string is being retrieved wiper material 60 can serve to wipe off mud and/or water from the stem pipe surface as the string is being pulled through aperture 39, substantially inhibiting these materials from accumulating in the room or on the drilling device.

Valving Units

Figure 7B:
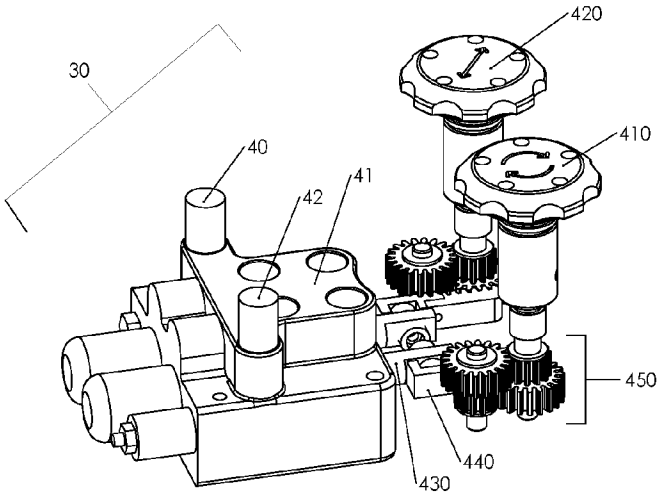
FIGS. 7A and 7B illustrate a hydraulic valving system of a hand-portable directional drill device in accordance with one embodiment of this disclosure.
Figure 7A:
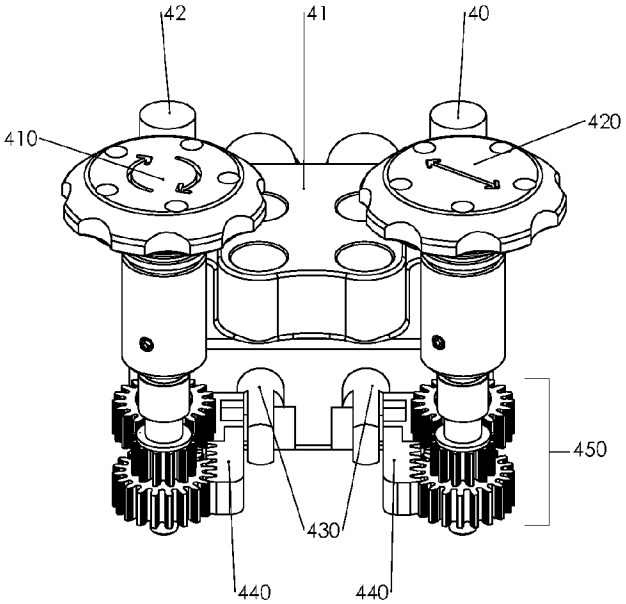

FIGS. 1B, 7A and 7B illustrate a valving unit useful in one embodiment of the hand-portable directional drilling device of the present disclosure. Those skilled in the art will appreciate that valving units are well-characterized and known in the art, and useful systems can be fabricated without undue experimentation. The valving unit in the figures comprises a standard hydraulic quick disconnect 4-position valving unit such as are well characterized in the art. The unit comprises a male hydraulic in port 40, a female hydraulic out port 42, a valving compartment 41, multiple hydraulic valve lines (e.g., 46, 48, 50, 52) transferring fluid as directed to drive activity, and means for directing fluid to the various hydraulic valve lines. U.S. Ser. No. 14/163,322, whose disclosure is incorporated hereinabove by reference, describes a valving unit wherein the means for directing fluid to the valve lines comprises a multi-positional lever or joystick. In FIGS. 7A and 7B, a valving unit mechanism is depicted comprising two independent gear-driven controls. Rotary drive control 410 independently directs fluid to the rotary stem pipe drive. Directional drive control 420 directs fluid to the carriage drive (illustrated in FIG. 1B as a roller chain drive). The independent gear-driven controls disclosed can have the advantage of providing greater control over the speed of the drives if this is desired.

As will be appreciated by those having ordinary skill in the art, a gear-based control system provides a means for transmitting rotational motion from an input gear to an output gear, varying the speed ratio by varying the gear ratio. Any useful gear ratio can be fabricated without undue experimentation. One commonly useful gear ratio is in the range of about 2:1, and the mechanism in FIGS. 7A and 7B depict one common embodiment for generating a 2:1 ratio. In the figure, the output gear associated with input gear 410 or 420 transmits the rotational motion to a gear rack 440, which manages movement of a spool 430 in and out of hydraulic valving unit compartment 41, thereby managing the volume of hydraulic fluid (and therefore power) to the associated motor.

Referring to FIG. 1B, one exemplary valving arrangement is illustrated. In the figure, hydraulic valve line 46 transfers fluid to directional hydraulic motor 250 following manipulation of directional valve control 410. This action causes the roller chain sprocket to turn counterclockwise, engaging roller chain 300 as it does so, thereby pulling carriage 20 and attached combined rotary drive unit 17 forward along chassis 12 (this and all directional views are from the perspective looking forward from the back of the drilling device). When hydraulic valve line 48 transfers fluid to hydraulic motor 250, the roller chain turns clockwise, and carriage 20 and attached rotary drive unit 17 move back along chassis 12. Of course, switching the attachment of valve lines 46 and 48 to the directional drive motor ports will reverse the valves' function. When hydraulic valve line 50 transfers fluid to rotary stem drive hydraulic motor 62, the drill stem rotary unit rotates in the clockwise position. When hydraulic valve line 52 transfers fluid to hydraulic motor 62, the drill stem rotary unit rotates in the counter-clockwise position. Of course, switching the attachment of valve lines 50 and 52 to the rotary stem drive motor ports will reverse the valves' function. Useful hydraulic motors having application in hand-portable directional drilling devices disclosed herein can be high-torque, low-speed motors, with operational rpm's in the range of at least about 200-600 rpm's, and hydraulic fluid gpm's in the range of at least about 10-25 gpm's. One useful hydraulic motor type that can be used to advantage is a gerotor or positive displacement pump.

Staging Mechanisms

Figure 8A:
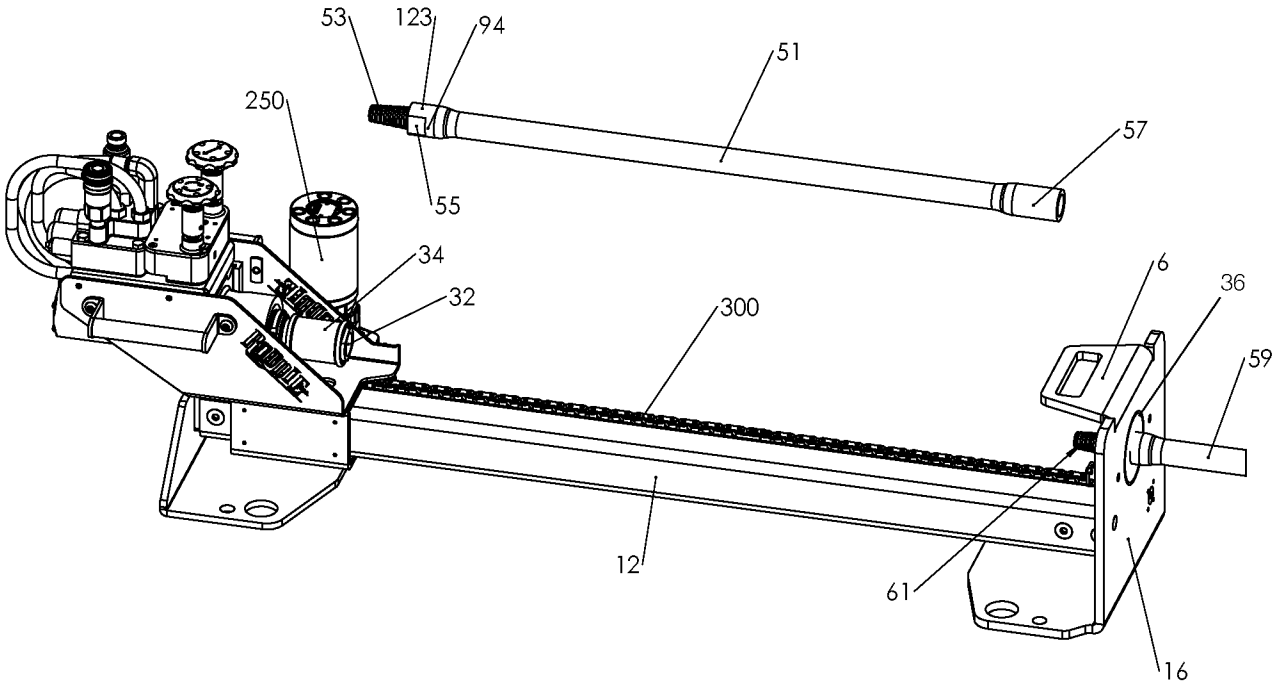
FIGS. 8A and 8B illustrate the staging positions of a single-stage hand-portable directional drill device in accordance with one embodiment of the present disclosure.
Figure 8B:
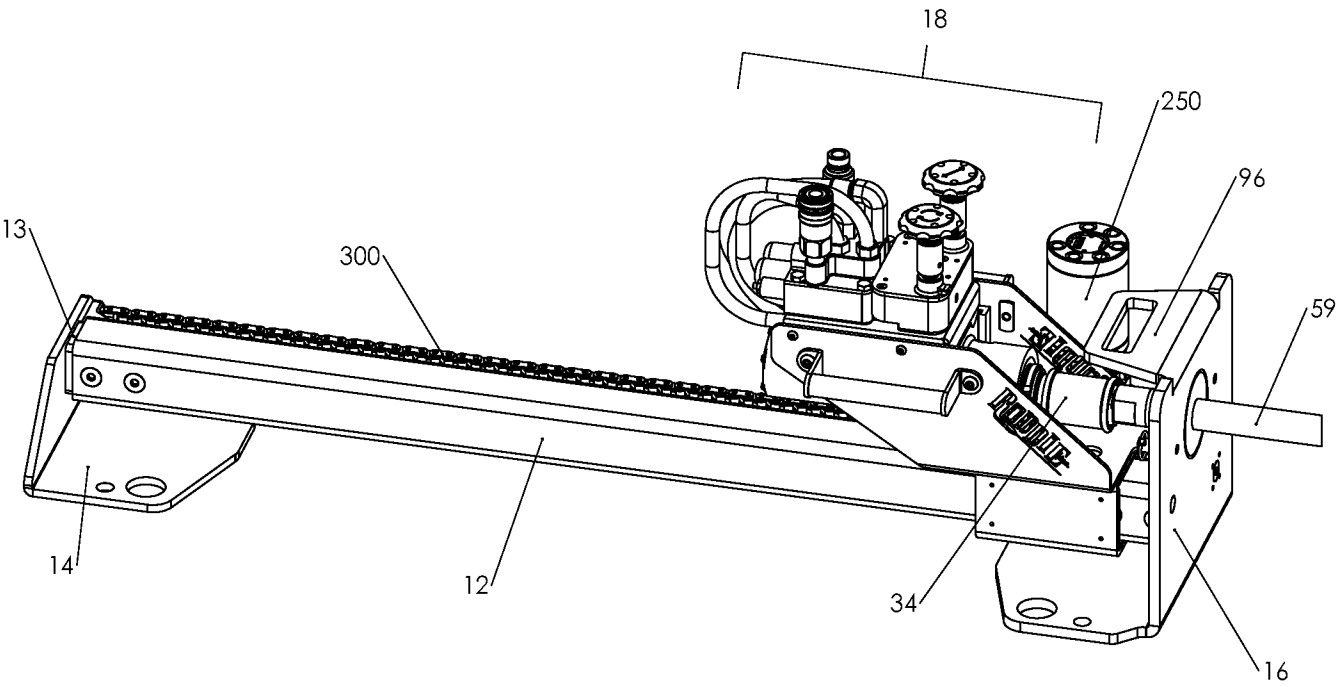

A dual staging mechanism is disclosed in detail in U.S. Ser. No. 14/163,322, incorporated hereinabove by reference. A representative single staging mechanism is depicted in FIGS. 8A and 8B, using the roller chain embodiment for illustrative purposes only. Turning now to the figures, and using FIG. 1B for reference, the process begins in the full back reset "stage 0" position illustrated in FIG. 8A, with carriage 20 and attached rotary drive unit 17 in the full retracted position, achieved by maneuvering directional control 20 to deliver hydraulic fluid to valve line 48 so that carriage 20 is moved back along chassis 12.

FIG. 8A also illustrates a drill stem section 51 about to be added to an existing drill string. The drill stem section provided in the present embodiment is illustrative of standard pin and box drill stems well known and characterized in the art. Drill stem 51 can comprise a tube having a central channel for optionally delivering lubricant to a drill head, a tapered threaded "pin" end 53 at the back end of the stem and an internally threaded "box" 57 at the front end of stem 51. The internal threads of box end 57 can be configured to receive and engage a tapered threaded pin end 53 from another drill stem 51, thereby forming a plurality of drill stems longitudinally engaged end-to-end to form a hollow drill string. Drill stem 51 further can comprise one or more breakout wrench receiving flats or depressions 55 on its outer surface substantially proximal to and forward of tapered threaded pin end 53. The flats or depressions can serve as externally accessed torque transfer means or as wrench receiving surfaces. Drill stems of particular utility in the devices of the present disclosure comprise at least two flats 55 diametrically opposed from one another about the outer surface of drill stem 51 and substantially at the same distance from the distal end of pin end 53.

In FIG. 8A an existing drill string 59 is illustrated, the back end of which, pin end 61, extends through drill bit hole 36. Drill stem 51 is added to the drill string by, for example, manually threading box 57 of stem 51 onto pin end 61 of drill string 59. Then directional control 420 is maneuvered to deliver hydraulic fluid through line 46 to move carriage 20 forward. As stem adapter 32, which has internal threads dimensioned to receive and engage a tapered threaded pin end 53, approaches pin end 53 of stem 51, rotary stem control 410 is maneuvered to deliver hydraulic fluid to valve line 50 so that adapter 32 rotates clockwise to engage pin end 53 and form an adapter/stem pipe joint 93.

Directional control 420 again can be maneuvered to deliver hydraulic fluid through line 46 to move carriage 20 forward, driving drill stem 59 along its intended underground path. Rotary stem control 410 also can be manipulated simultaneously to rotate the drive string if desired.

FIG. 8B shows the rotary drive unit at the front of chassis 12. In this position, referred to herein as "stage 1", adapter/stem pipe joint 93 is proximal to wall mount 16, and drill stem 51 is ready to be disengaged from drill adapter 32. An example for facilitating cracking or breaking the adapter/drill stem joint 93 in accordance with an embodiment of the present disclosure is described with respect to FIGS. 9A-9C below. Once joint 93 is broken, directional control 410 then can be maneuvered to deliver hydraulic fluid to valve line 52, rotating adapter counter-clockwise to completely disengage adapter 32 from pin end 53.

Carriage component 18 then is restaged to its start position for receiving a new stem pipe 51 to be added to drill string 59 by maneuvering directional control 420 to deliver hydraulic fluid to valve line 48, moving carriage 20 back to the fully retracted "reset" position (stage 0) illustrated in FIG. 8A.

As will be appreciated by those having ordinary skill in the art, drill stem pipe dimensions can vary for different desired applications. Generally useful drill stem pipes comprise 41/40 steel. Drill stem pipes that accommodate the dimensions of the hand-portable drilling device disclosed herein and optimize the staging process disclosed herein have an overall length in the range of at least about 20-40 inches, including 24-inch and 1-meter length pipes, have an outer diameter in the range of about 1.5-2.0 inches, and have an inner diameter in the range of about 0.25-0.625 inches. Smaller stem pipes bore or inner channels, for example, having diameters in the in the range of about 0.3-0.4-inches, have the advantage of reducing the amount of lubricant that traverses through the drill string and which may need to be captured during drilling and/or retrieval of the drill string.

Also as will be appreciated by those having ordinary skill in the art, useful bore diameters include those that deliver lubricant to a drill tip in the range of at least about 5 gpm's for a 200-250 ft drill string and also accommodate in the range of at least about 10 gpm's for 70 ft drill strings. Useful pipe stems also comprise wrench flats as described herein having substantially standard dimensions well used and characterized in the art, typically having substantially similar widths and lengths, and generally in the range of about 0.7-1.0 inches.

Magnetized Wrench Collar

Figure 12C:
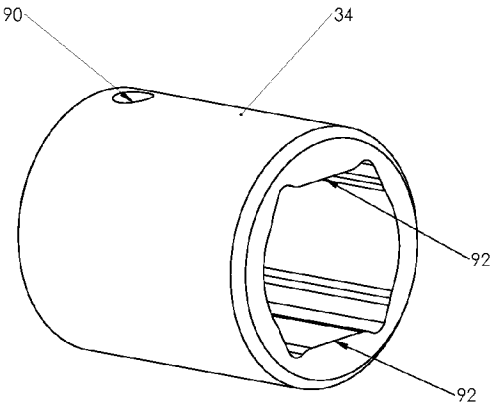
FIGS. 12A-12C illustrate three positions of a magnetized wrench collar of a hand-portable directional drill device in accordance with one embodiment of this disclosure.
Figure 12B:
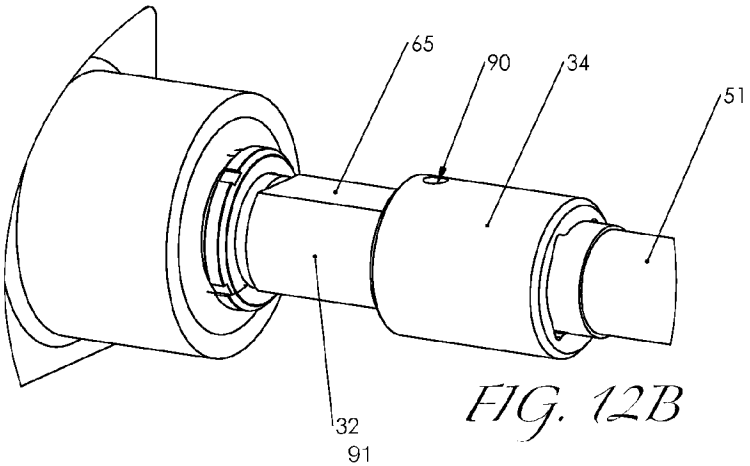
Figure 12A:
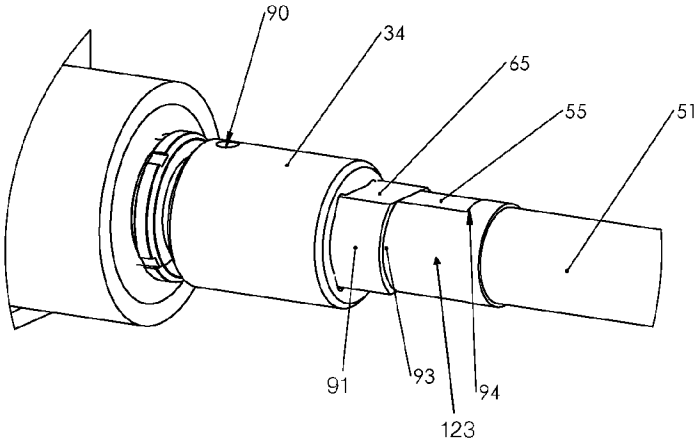

Referring now to FIGS. 12A-12C one embodiment of a magnetized wrench collar useful in the devices of the present disclosure is illustrated. It will be appreciated by those having ordinary skill in the art that the fixable, positionable collar disclosed herein has application beyond the present devices and finds utility in any application where a readily accessible, easily engaged and removable anti-torquing means is desired. Particularly useful are any jointing applications comprising rod or tubular components and joints, where anti-rotational or anti-torquing action is desired and where regular repeated access to the joint is preferred. Useful joints include those in any drilling application and could include, without limitation, angled joints.

Figure 10A:
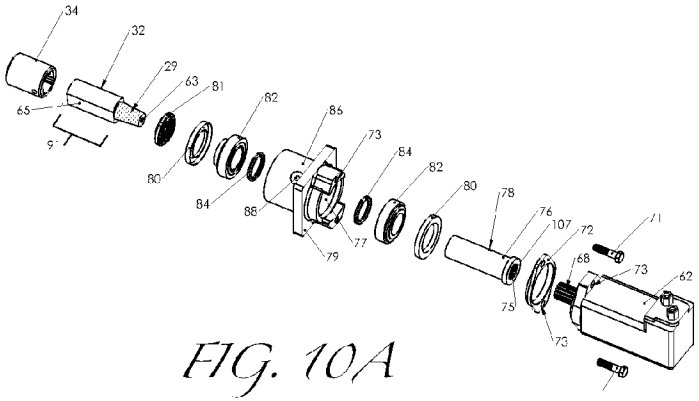
FIGS. 10A and 10B depict views of a rotary drive unit in accordance with one embodiment of this disclosure.
Figure 10B:
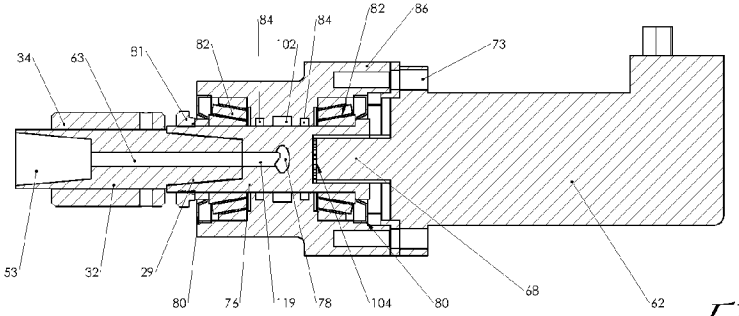
Figure 11B:
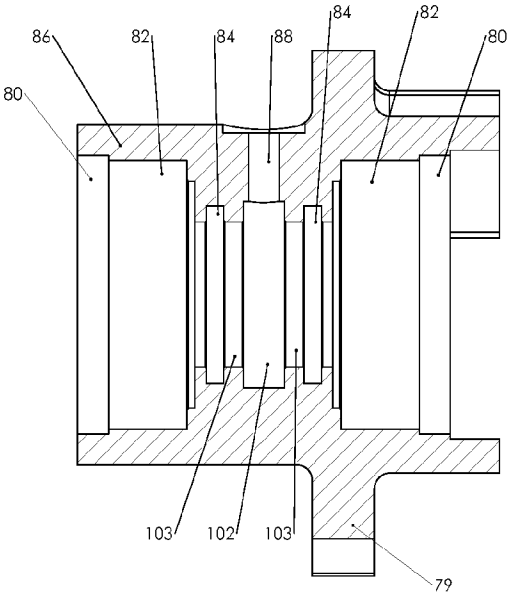
FIGS. 11A and 11B are cross-section views of a water spindle unit housing in accordance with one embodiment of this disclosure.
Figure 11A:
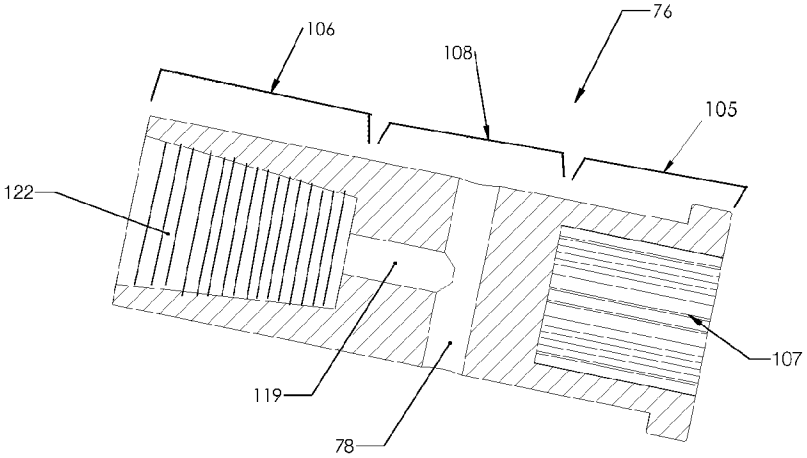

Referencing FIG. 10A, drill stem adapter 32 can have opposing parallel flats 65 machined along the outside barrel length 91 of adapter 32 anterior to threaded pin end 29. Flat 65 can have a dimensional width substantially matching flat 55 on a drill stem section 51. Collar 34 can comprise a hollow sleeve or channel competent to slide over a drill stem section 51 or an adapter 32. In this embodiment, the inner sleeve or channel can have a diameter sufficient to contact, receive and slide over adapter stem 32 and flat 55 of attached drill stem section 51. Forward movement of collar 34 along pipe stem 51 can be prevented by a lip 94 at the anterior end of flat 55.

Collar 34 further can comprise at least one magnet 90, such as a rare earth magnet, embedded in a surface of the collar. Typically, magnetized wrench collars useful in the directional drilling devices disclosed herein comprise two magnets 90 diametrically opposed from one another about the circumference surface of collar 34. Magnet(s) 90 are of sufficient strength to magnetize collar 34 such that collar 34 removably can engage with the metal surface of an object in contact with the collar's inner surface. In the illustration such objects include stem adapter barrel 91, stem pipe flat component 123, and an adapter/stem pipe joint 93. Magnetized collar 34 can have an inner circumference contour dimensioned to mirror the outer circumference contour of adapter 32 and the stem flat component 123 of a stem pipe section 51. That is, the inner contour of collar 34 can comprise opposing parallel flats 92 machined along its internal longitudinal axis, the flats 92 having substantially the same dimensional width as flats 55 and 65.

When not in use, collar 34 can sit on adapter 32's barrel section 91, back away from joint 93 in a "resting" position, with magnet(s) 90 keeping collar 34 in position. In operation, a pipe section 51 is threaded into adapter 32 such that flats 65 and 55 are aligned. Collar 34 can be slid over adapter/stem joint 93 until forward movement is stopped by lip 94. Magnet(s) 90 hold collar 34 in place over the joint, and the collar's inner circumference contours holds joint members stable relative to one another, preventing undesired unthreading when pipe sections are being cracked open during pipe string retrieval, as is described in Example 3 below. While collar 34 also can be used to prevent over-torquing or over-rotation, for example while attaching pipe section 51 to the drill string or during drilling of the string, drill stem joints having utility in the present disclosure typically use tapered threads designed and fabricated to prevent over-torquing when engaged, and so use of collar 34 is not required during forward drilling operation. Contact surfaces of collar 34, adapter 32 and/or pipe stem flat 55 can be lubricated to reduce friction and facilitate collar movement on and off joint 93. The outer surface of collar 34 further can be textured as by hatch marks or grooves, for example, for enhanced gripping during operation. Alternatively, the collar front end can comprise a lip as illustrated in FIG. 2, for example, which can provide resistance when gripping the collar during operation.

It is within the skill of the art to vary the number, location, size and strength of magnets on a surface of a wrench collar of the present disclosure. It also is within the skill of the art to modify the contours of the collar's inner dimensions to mirror other useful joint member outer contours or for other applications. Key features of the magnetized collar disclosed herein are its ability to removably or temporarily stay attached to any location where it is placed, while also easily being disengaged from that position and moved to another position (e.g., resting or operational) as desired, particularly where the resting and operational locations are contiguous and substantially adjacent or proximal to one another. Preferred magnet strengths will depend on metal thickness, collar size, and operational conditions such as vibration and torque, all of which are within the skill of the art to determine. Useful magnets 90 can be ⅜-inch (0.375-inch) N50 magnets, also known as rare earth or neodymium magnets, and magnets of stronger and weaker strength also are contemplated.

Magnetized Breakout Wrench

Figure 9B:
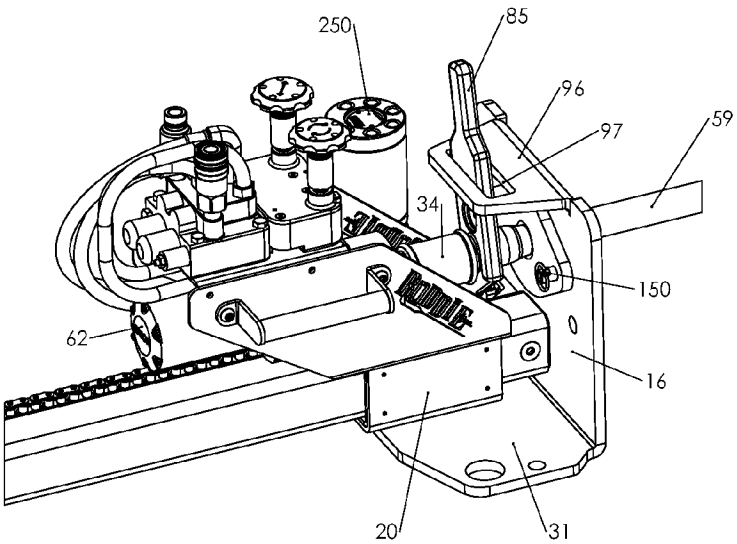
FIGS. 9A-9C illustrate illustrate positions of a magnetized wrench collar of a hand-portable directional drill device in accordance with one embodiment of this disclosure.
Figure 9A:
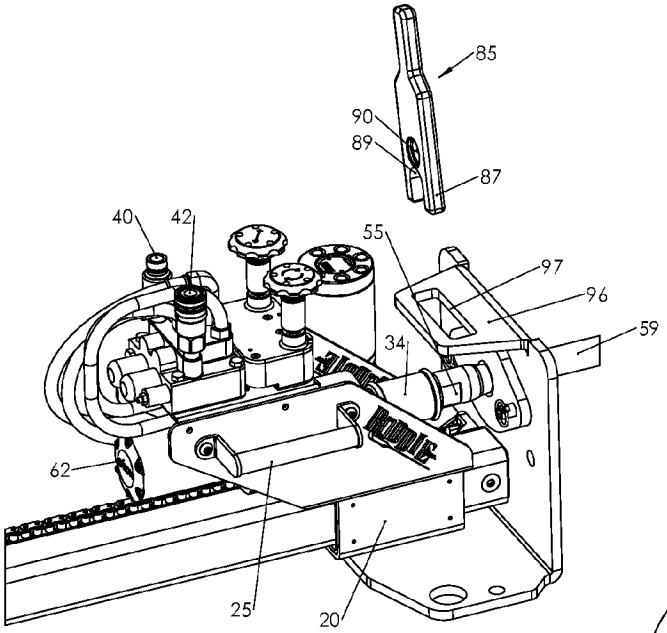
Figure 9C:
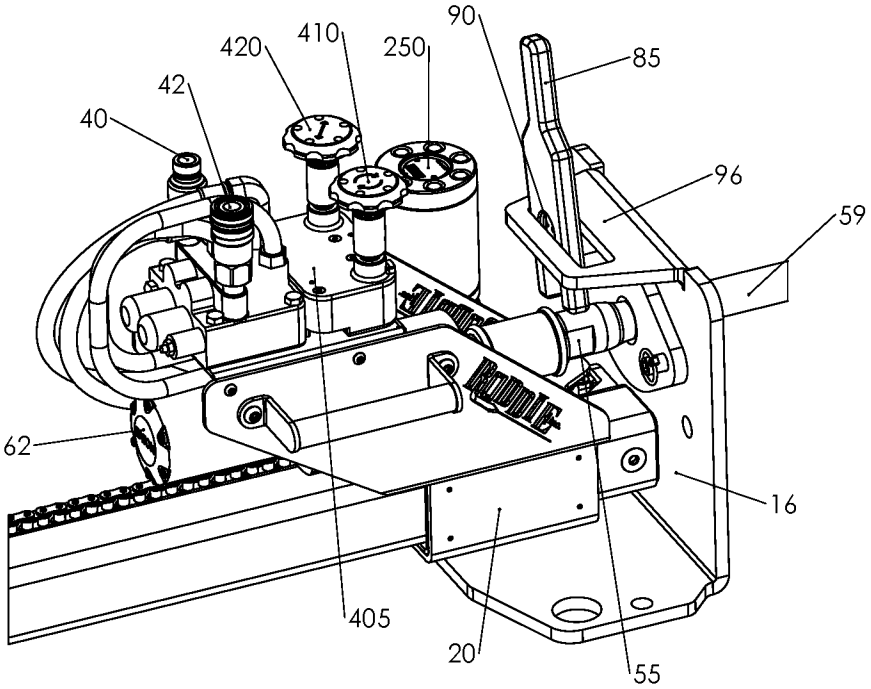

FIGS. 9A-9C illustrate one embodiment of a device and breakout technique for breaking or cracking open pipe section joints created using devices of the present disclosure. A more detailed description of the technique and device also can be found in U.S. Ser. No. 14/163,322, disclosed by reference hereinabove.

With reference to FIG. 8B, illustrating a device in accordance with an embodiment of the present disclosure and wherein the carriage is in the full forward position, having attached a drill stem 51 to an existing drill string 59 and drilled stem 51 forward on the device, the adapter/stem joint 93 now needs to be cracked or broken open to release the device from drill string 59. FIG. 9A illustrates a wrench element useful in this cracking or breakout step. In the figure, wrench element 85 describes a horseshoe wrench having legs or gripping jaws 87 defining a radius 89 dimensioned and adapted to fit over and fit snugly on stem flats 55. Optionally, wrench element 85 can include a grip or handle. The device and method further can comprise wrench stop means competent to inhibit rotation of wrench element 85 about the radial axis of the stem joint. In this embodiment a bracket 96 can be attached to wall mount 16 substantially above where the pipe joint is positioned in the full forward position. Bracket 96 further can comprise a slot 97 which can double as a carriage component carrying means 6. Other useful configurations are within the skill of the art to design and fabricate.

Bracket 96 with slot 97 can serve several purposes. First, wrench element 85 and bracket 96 are dimensioned such that wrench element 85 can pass through slot 97 and sit on pipe stem 51 such that its legs or gripping jaws 87 are in contact with the pipe stem's flats 55. The bracket is positioned at a height above the pipe joint such that at least a portion of the top of wrench 85 protrudes up through slot 97. The dimensions of slot 97, limit the rotational movement of wrench 85 about the axis of the pipe joint, thereby creating a functional wrench stop. The pipe joint typically can be cracked by maneuvering stem drive control 410 to rotate adapter 32 counter-clockwise. The wrench stop, with the wrench engaged with pipe stem flat 55, prevents rotation of drill string 59 while stem adapter 32 is being rotated, allowing the joint seal to be broken. In this disclosure, where the pipe joint is composed of adapter 32 and a stem pipe section 51, the joint is referenced herein as joint 93. Where the pipe joint is composed of two stem pipe sections 51, the joint is referenced herein as joint 111.

When a drill string is being retrieved, a joint 93 between pipe stem adapter 32 and drill string 59 first can be cracked open as described above. Collar 34 then is engaged with joint 93, and carriage 20 is moved back to its full re-set position as described in Example 3 below, bringing with it pipe string 59 so that the next proximal forward pipe joint 111 is available to the drill stem joint wrench breakout system. Wrench 85 then can be used to crack open this joint 111 so that newly exposed pipe stem 51 can be easily unthreaded from both stem adapter 32 and the drill string 59. Thus, bracket 96 and slot 97 together provide the means for limiting rotational movement of wrench 85 and therefore of stem pipe 51, when wrench 85 is engaged with stem pipe 51, allowing the joint seal to be broken.

Bracket 96 also can provide a means for storing wrench 85 when not in use. Optionally, bracket 96 or wrench 85 can be magnetized, for example at position 90 allowing wrench 85 to be removably attached to bracket 96 when not in use. It will be appreciated that more than one magnet also can be used. As above, useful magnets 90 can be ⅜-inch (0.375-inch) N50 magnets, also known as rare earth or neodymium magnets, and magnets of stronger and weaker strength also are contemplated.

Stem Drive Units

FIGS. 10A, 10B, 11A and 11B illustrate a rotary drive unit and components thereof in accordance with one embodiment of the present disclosure. A more detailed description of the unit and components also can be found in U.S. Ser. No. 14/163,322, disclosed by reference hereinabove. The rotary drive unit differs from similar units in the art at least in that hydraulic motor 62 attaches directly to rotary drive housing 86 by means of motor adapter 72, and main shaft or spindle 76 can be dimensioned to fit inside housing 86 without extending substantially therefrom. In particular, spline engagement of shaft 76 with splines 68 of motor 62 occurs within water housing 86.

Shaft or spindle 76 can comprise internal splines 107 at its back end, dimensioned to engage splines 68 extending forward from hydraulic motor 62. Engaged splines 104 are shown in cross-section in FIG. 10B. In rotary drives of the art, water housing 86 typically is attached to motor 62 by means of an external plate/spline assembly and can be placed separate from the spindle bearing assembly, extending the length of the drive unit by multiple inches, and adding weight to the device. As illustrated in FIGS. 10A and 11, shaft 76 can comprise a cylinder having an opening 75 extending part way in to the interior of the cylinder from both ends of the cylinder and comprising substantially three separate internal sections along its central longitudinal axis. A first section 105 at the back end of shaft 76 can have an inner surface 107 defining splines that engage splines 68 on hydraulic motor 62. A central section 108 can serve as a lubricant cavity, isolated from spline section 105. Central section 108 can include two port openings 78, diametrically opposed from one another about the circumference of spindle 76, and that receive lubricant from housing 86 lubricant cavity 102.

Central section 108 further can include an opening 119 dimensioned to deliver lubricant into a third section 106 at the front end of shaft 76. More particularly, opening 119 can be dimensioned to deliver lubricant to the hollow bore 63 of a pipe stem adapter 32. Accordingly, front section 106 can have an inner surface 122 comprising internal threads dimensioned to receive and engage a hollow threaded tapered "pin" end 29 of drill stem adapter 32. Bolts 71 can attach hydraulic motor 68, adapter 72, and housing 86 by means of bolt holes 73.

Housing 86 can define a hollow sleeve 77 having an internal diameter 103 dimensioned to allow shaft 76 to pass through it. Reasonable clearance distances between the shaft 76's outer diameter and housing 86's inner diameter 103 can be in the range of at least about 0.001 inches. Housing 86 also can comprise a central radial channel or cavity 102 that receives and holds drill head lubricant provided to the housing interior by means of port 88, and a plurality of grooves or radial channels that extend out from either side of cavity 102 to seat seals and bearings that support efficient drill stem rotation.

Housings 86 useful in the hand-portable directional drilling devices of the present disclosure can include at least six grooves or channels, or two sets of three matching and axially opposed grooves or channels that extend out from lubricant cavity 102, each groove set comprising, from the innermost position and extending out: a groove or channel dimensioned to receive and seat a water seal 84, followed by a groove or channel dimensioned to receive and seat a roller bearing, typically a tapered roller bearing 82, and a groove or channel dimensioned to receive and seat an oil or grease seal 80. Each of bearings 82 and seals 80 and seals 84 can be of an annular shape having an inner diameter through which shaft 76 can pass. A bearing nut 81 can attach to the front end of housing 86, having an annular shape with an inner diameter through which spindle 76 can pass. As will be appreciated by those having ordinary skill in the art, the overall lengths of housing 86 and shaft 76, and the distances between bearing grooves and seal grooves can be modified without negatively impacting operation of the device. Preferred useful dimensions that maximize function and compactness are well within the skill of the art to select.

Drill stem adapter 32 further can comprise an internal bore or channel 63 that can traverse the longitudinal axis of the adapter and through which fluid can flow through the drill string central bore or channel to the drill head during drilling. Housing 86 further includes a port 88 (see FIG. 10) for providing a drill head lubricant to adapter 32 by means of opening 78 in shaft 76. In the present illustration port 88 occurs in the "11 o'clock" position on the housing circumference. It will be appreciated that, while the longitudinal axial position of the port along the housing surface is determined by the position of the internal channels or grooves, the circumferential position of the port on the housing can be varied as desired for ease of lubricant line access. Water is a useful lubricant well characterized in the art and has utility in devices of the current disclosure. Pressurized water lines attached to port 88 typically can include a gauge for measuring water pressure in the line.

Housing 86 as illustrated here further can comprise a frame 79 dimensioned to provide means for seating and stabilizing rotary drive unit 24 in frame 118, for example, braced within sleeves 109 of frame 118, as illustrated in FIG. 2.

Drill Head

Figure 17A:
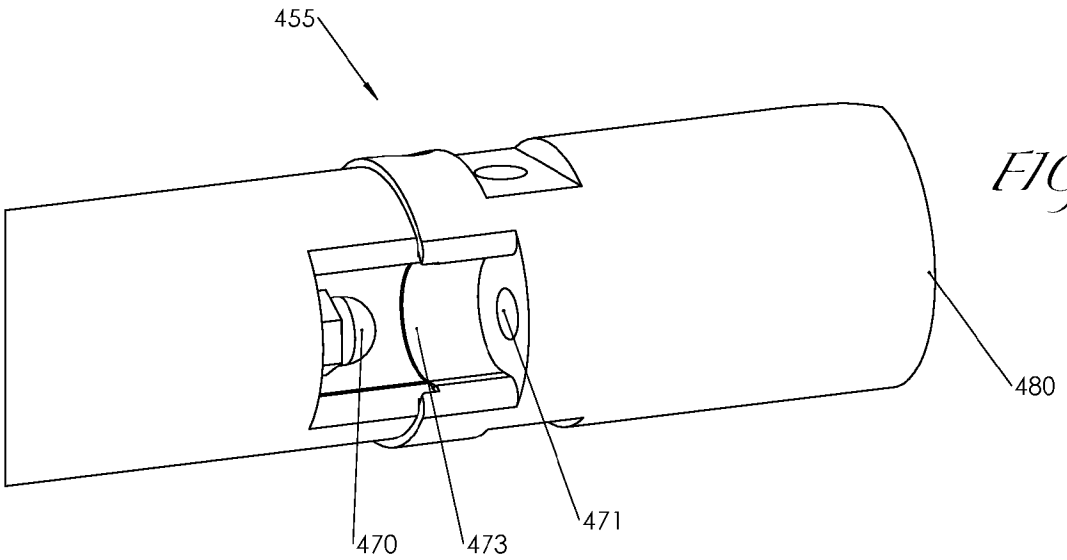
FIGS. 17A-17C illustrate a modified drill head in accordance with one embodiment of the present disclosure.
Figure 17B:
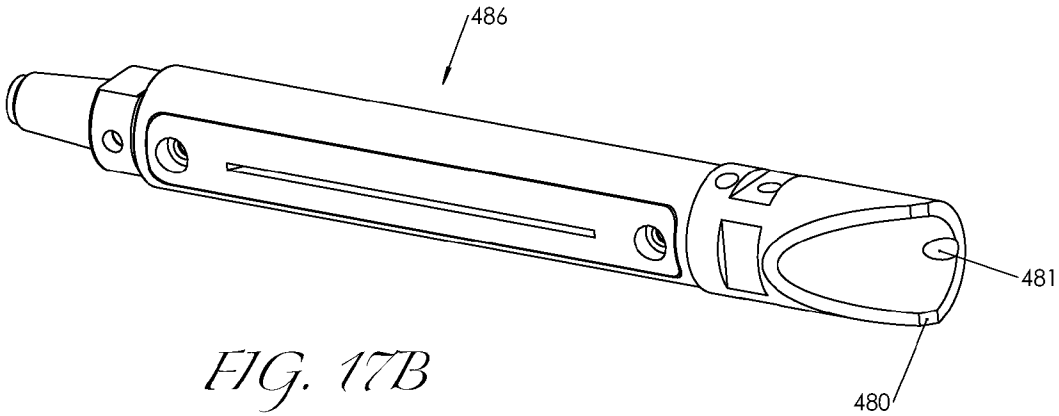
Figure 17C:
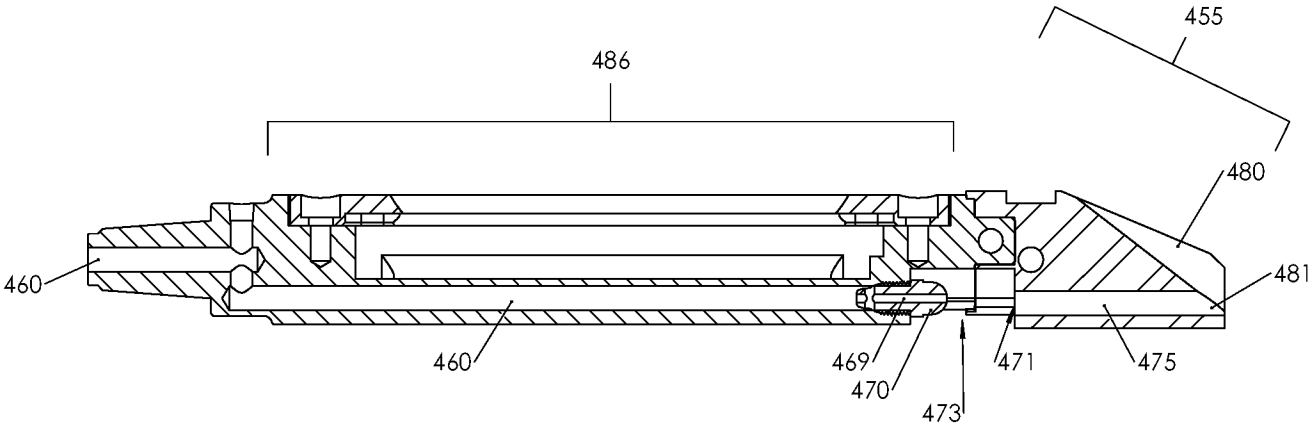

FIGS. 17A-17C illustrate an improved drill tip useful in directional drilling or otherwise traversing a space underground. Drill heads useful in directional drilling typically comprise typically comprise a drill tip 480 at the drill head's anterior end, contoured and dimensioned to support carving a space through dirt and/or rock underground; a sonde housing 486 for directing positioning of the drill head by an operator above ground; adapter means at the drill head's posterior end for attaching to the front end of a drill stem; a channel 460 for delivering lubricant, typically water, to the drill tip from the drill string, and fluid hole(s) 481 at or near the drill tip for releasing the lubricant. Drill heads in the art may or may not also comprise a nozzle in channel 460 at or near fluid hole 481 in drill tip 480. Nozzles can serve to concentrate the water stream for better lubricant delivery through accumulating debris at the drill tip. Often, drill tip 480 can be removably attached to the front end of sonde housing 486.

A common problem that impacts efficient operation of drill heads in the art is clogging of fluid hole 481, even with a nozzle 470. Setting the fluid hole back from the drill tip does not solve the problem. The drill head disclosed herein differs from the drill heads in the art to overcome the clogging issue. Specifically, the drill head disclosed herein comprises a debris release cavity 473 set back from the drill tip edge. In a preferred embodiment the debris cavity defines an opening on the drill head's lateral surface. In one useful embodiment the cavity occurs at the juncture of the drill tip and the sonde housing with the nozzle placed at the back end of the cavity, extending out from the anterior end of channel 460 in sonde housing 486. The posterior end of drill tip's lubricant channel 475, opening 471, sits at the anterior end of cavity 473.

Cavity 473 can serve to disperse and release debris that can accumulate in channel 475 before it reaches nozzle 470. Moreover, nozzle 470 concentrates the lubricant (eg., water) sufficiently to propel a directional projection of lubricant across the gap between the nozzle and drill tip lubricant opening 471 and into drill tip channel 475, including propelling the lubricant through any debris that may accumulate in the cavity itself. In one embodiment, the improved drill head disclosed herein can propel a beam of lubricant through a captive tunnel 475. In another embodiment, the propelled beam of lubricant is sufficient to clear debris from the face of the tunnel, namely at opening 471, including debris that clogs the opening. The drill head configuration disclosed herein provides a nozzle means for continually clearing clogged fluid holes during operation without also clogging the nozzle. In addition, drill tip 480 can comprise an angled surface having a curved edge for improved carving into dirt underground. In the figure, the curved edge is convex.

II. Screw-Driven Hand Portable Directional Drill

FIGS. 13-16 illustrate various embodiments of another single stage direction drill and method. In the figures a stationary screw 200 provides the hydraulically powered means for moving a rotary drive component 18 along the chassis beam 12. Like the roller chain, the stationary screw can be attached to front plate 16 and back plate 13 by means of a bolt plate 201 and bolt means 202.

Carriage 20 and attached rotary drive component 18 can travel along chassis 12 on demand by means of a spur gear mechanism 205 that engages screw 200. In the figures, hydraulic motor 250, powered by a valving unit on component 18, drives the spur gear mechanism inside housing 260. The gear mechanism, including housing and motor, can be attached to carriage 20 by any standard attachment means, including any bracket or bracing means such as bracket means 265.

Figures 14A, 14B:
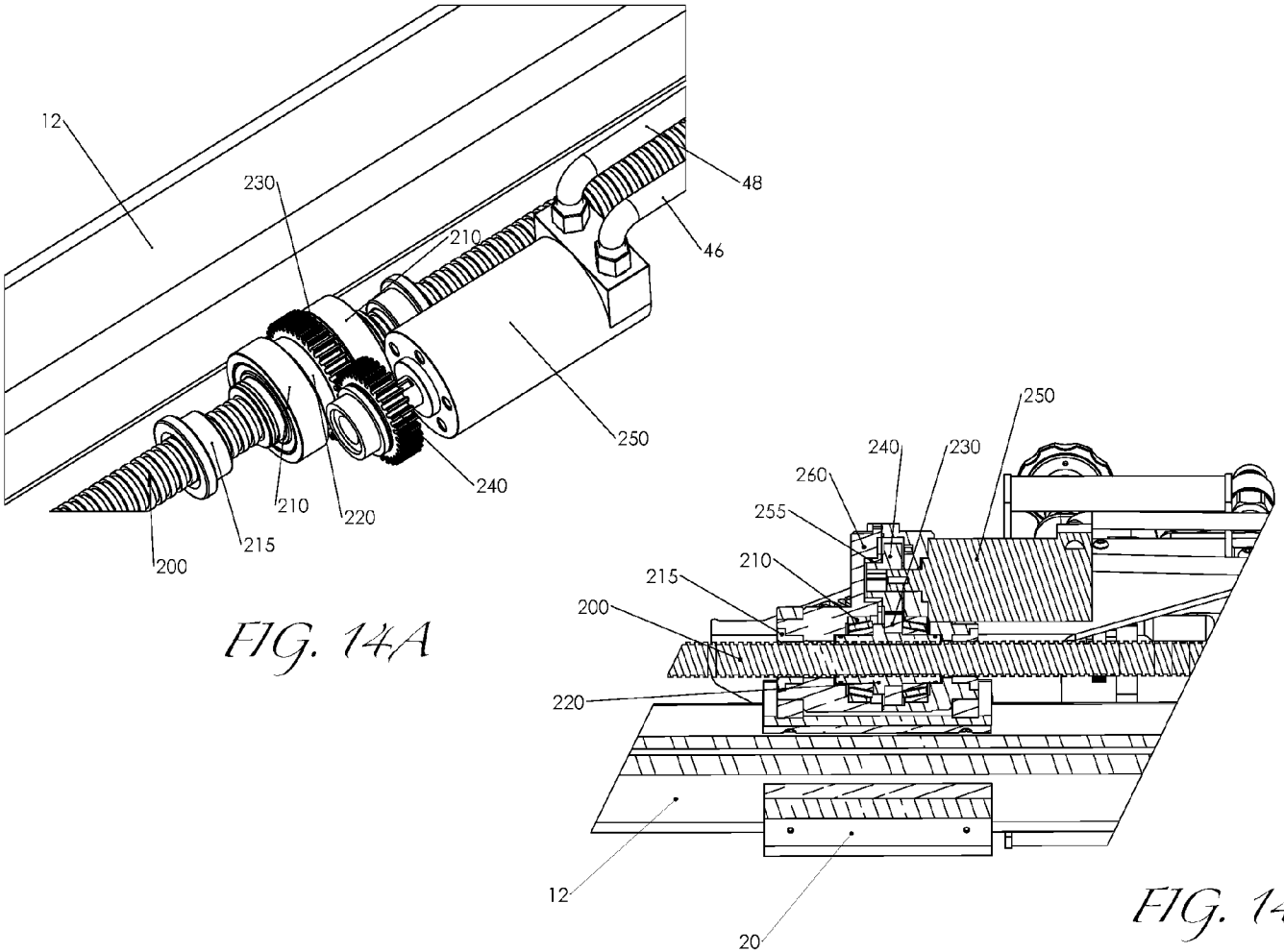
FIGS. 14A and 14B illustrate two views of a screw drive gearing mechanism in accordance with one embodiment of this disclosure.

FIGS. 14A and 14B illustrate one spur mechanism useful in the screw drive of the present disclosure. Those skilled in the art will appreciate that variations on this embodiment, and other embodiments are within the skill of the art to fabricate provided with instant disclosure. In the figure, a spline shaft extending out from hydraulic motor 250 engages spur gear 240 whose teeth can mesh with those on pinion gear 230 to rotate that gear. Pinion gear 230 can be bolted or otherwise associated with a threaded nut 220 whose threads engage with those on screw 200 such that spur gear mechanism 205 and attached carriage 20 and rotary drive component 18 travel along screw 200 as the engaged spur and pinion gears rotate. In one example, hydraulic fluid provided to valve line 46 by means of a directional drive control 420 can produce spur gear 240 rotation such that component 18 moves forward along chassis 12. Similarly, providing fluid to valve line 48 can induce rearward movement of component 18 along chassis 12. Of course, as for the roller chain embodiment above, switching the positioning of valves 46 and 48 on hydraulic motor 250 would reverse the directional function of these two valve lines.

Spur gear mechanism 205 further can comprise bearings 210 and alignment bushings 215 on screw 200 and bushings 255 on hydraulic motor 250. Housing 260 can be fabricated to provide stability to the mechanism as well as provide protection from debris, and at least alignment bushings 215 can be press-fit into housing 260 for additional stability. One useful material for housing 260 can include a 70/75 aluminum, and other suitable lightweight, durable materials are well characterized in the art and can be used to advantage.

Useful screw drive materials are those that are corrosion-resistant and provide the desired tensile strength, such as a hardened steel. One exemplary useful material includes an alloy, such as a chromoly steel, including the 4,000 series. Similarly, selection of the drive screw pitch will depend on the desired force and speed capabilities of the directional drill. In the example where desired working strength is in the range of about 4,000 pounds and directional speed is in the range of about 10 feet/minute, useful screw pitches can include between about 1 in 5 threads/1-inch OD to about 1 in 9 threads/1-inch OD. Those skilled in the art will appreciate that screw threads also can be square or angled. One currently preferred thread form is the ACME thread form.

Figure 15:
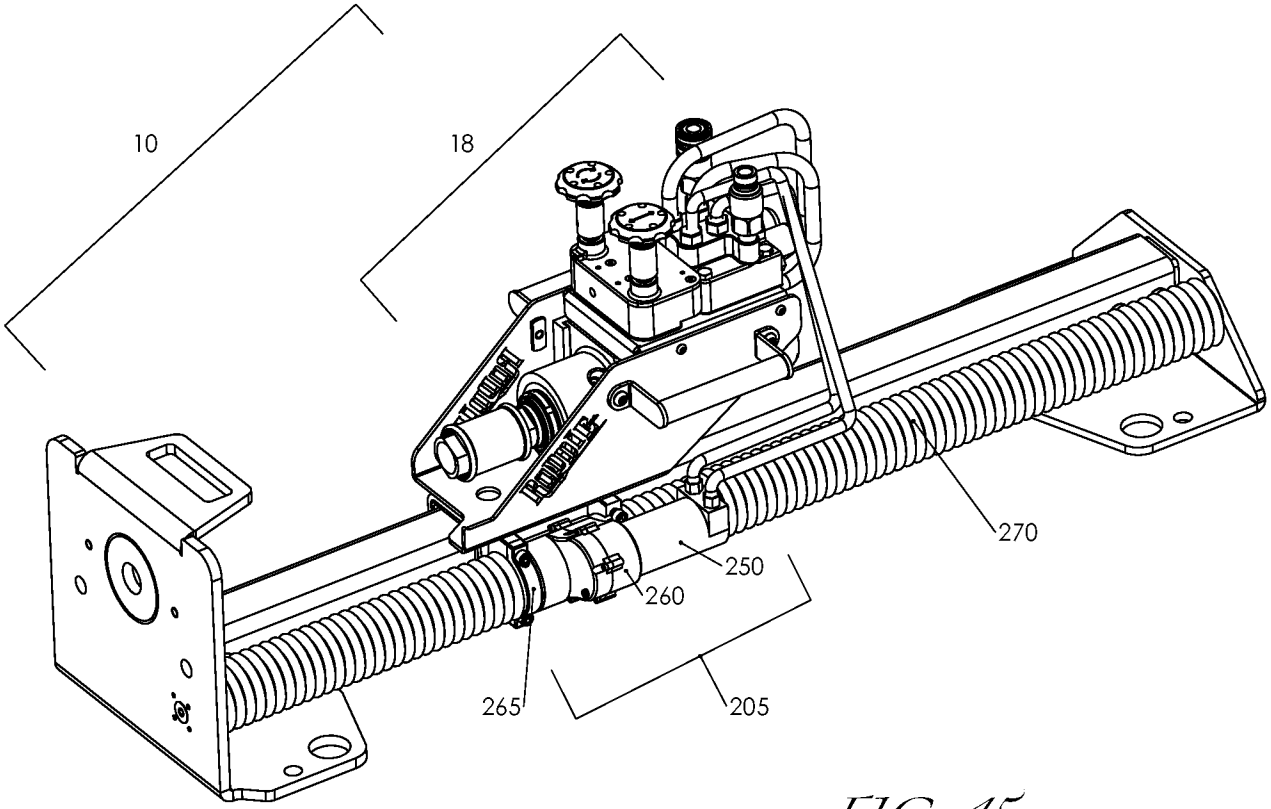
FIG. 15 illustrates a bellows shroud for a single-stage hand-portable directional drill in accordance with one embodiment of this disclosure.

FIG. 15 illustrates one embodiment of a flexible covering to protect screw drive 200 from debris during operation. In the example, the flexible covering can comprise an accordion cover or bellows 270 that surrounds screw drive 200 and attaches by standard means to front plate 16 and back plate 13. Useful flexible coverings can be fabricated by standard means using well-characterized materials that provide suitable flexibility and durability. Preferably, the selected material is wear-resistant, corrosion-resistant, and optionally UV-resistant. Useful materials can include natural or synthetic rubber, silicone-rubber, and the like.

Figure 16:
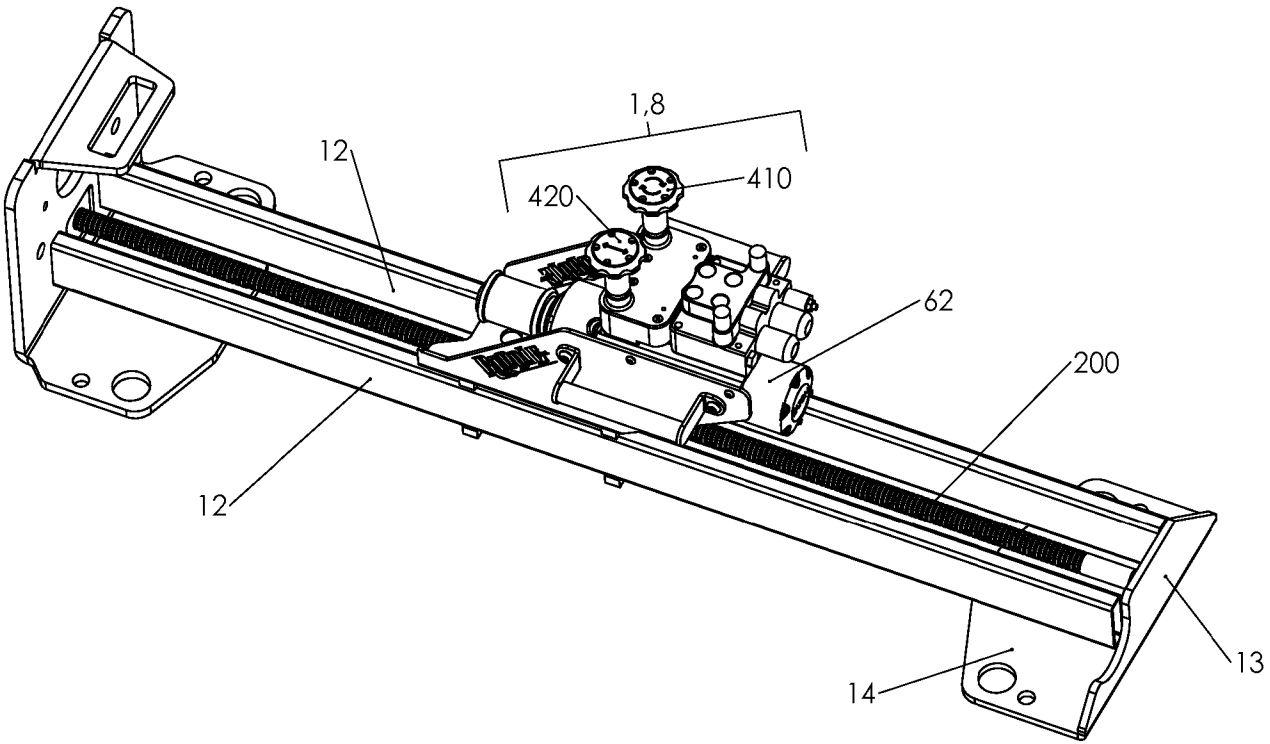
FIG. 16 illustrates a single-stage hand-portable directional drill comprising a centrally positioned directional drive unit in accordance with one embodiment of this disclosure.

FIG. 16 illustrates another embodiment of a single stage directional drill. In this example, the directional drive means, here screw 200, is centrally located on chassis component 11 rather than positioned lateral to it. In the figure, chassis beam 12 is effectively split into two parallel components and drive screw 200 is positioned between them. This positioning can reduce the overall height of the directional drill. In another embodiment, the drive means can also sit above chassis beam 12. The directional drive mechanism can be positioned under frame 118 in a functional assembly to engage the pinion gear on the drive screw, and movement of carriage component 18 managed by directional control 420. Component 18 can be coupled to chassis 12 by opposing carriage cuffs that surround and slide along chassis beam components 12 and as described hereinabove. Alternatively, and as illustrated in the figure, a slidable bracket that slides along a top and/or bottom rail on the chassis components. In still another embodiment, carriage 20 can comprise a pair of opposing projections or tongues or keys that can engage and slide along parallel, opposing grooves or channels that traverse in the length of the component beams' inside edge. The directional drill further can include a flexible covering or bellows to surround drive screw 200 as described in FIG. 15 above.

Transporting the directional drills of the present disclosure to a launch site comprises the steps of providing or separating components 11 and 18 and carrying them individually to a desired location. As described above, carriage component 18 can include one or more handles 25 positioned for ease of access and carrying component 18 without interfering in the operation of the drill. Similarly, wall mount plate 16 can include a handle 6 for ease of carrying chassis component 11.

Figure 13A:
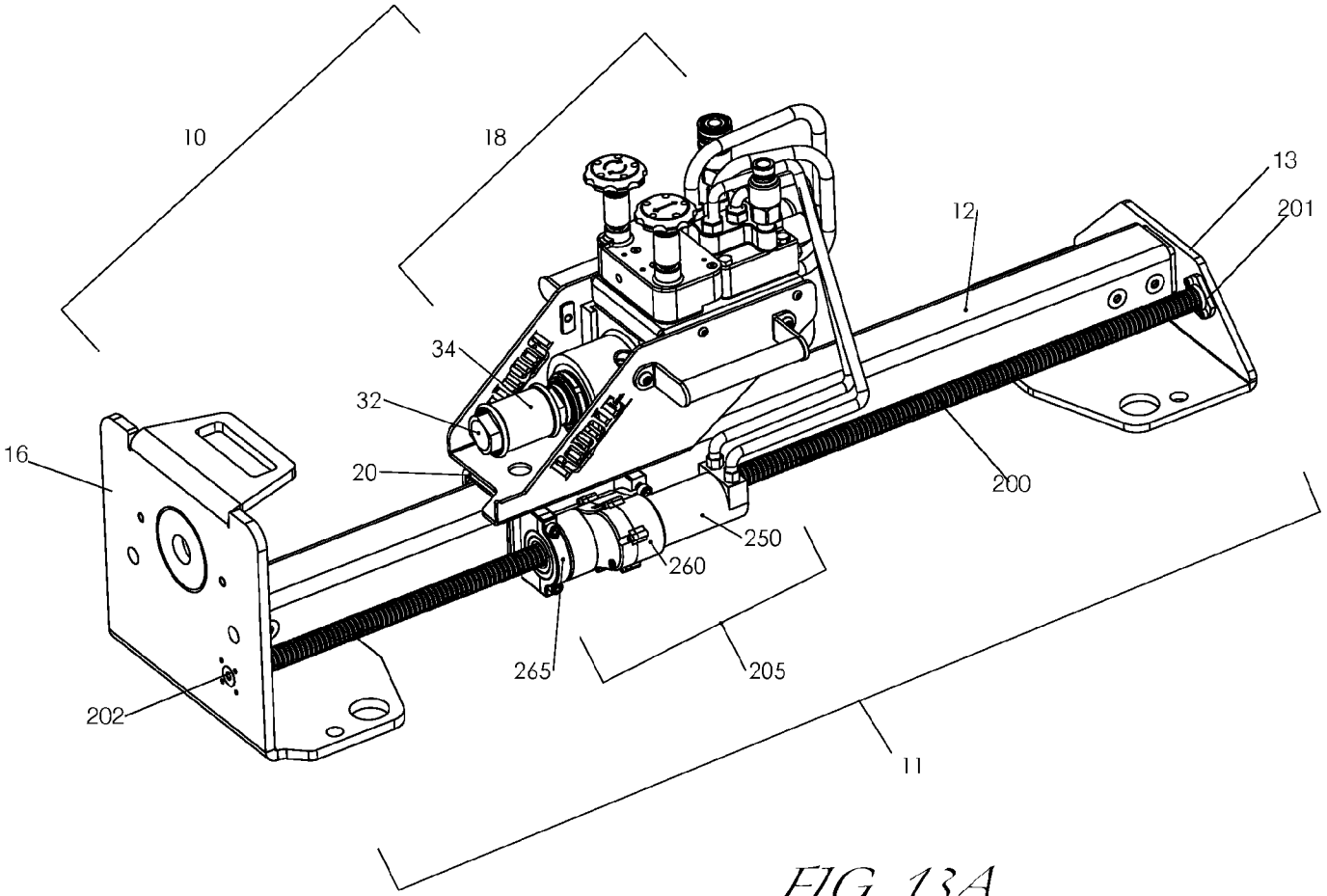
FIGS. 13A and 13B illustrate two perspective views of a single-stage hand-portable directional drill comprising a screw drive in accordance with one embodiment of this disclosure.
Figure 13B:
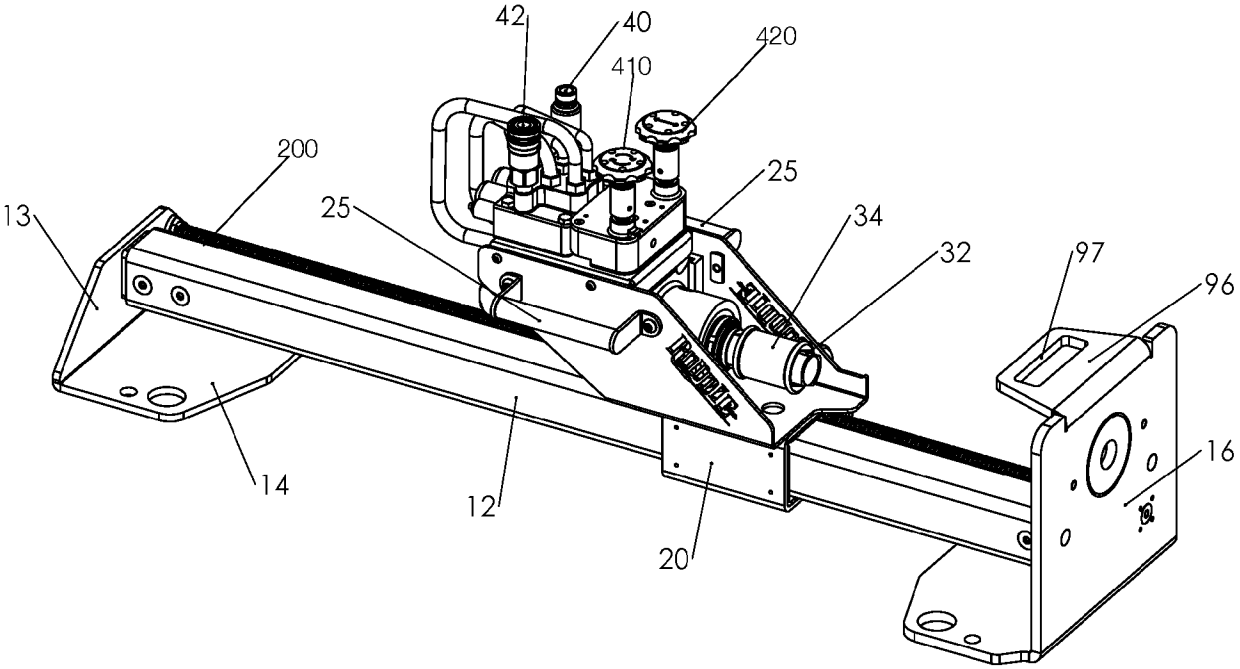

Referring to FIGS. 1 and 13, In the roller chain embodiment, disengaging components 11 and 18 can be accomplished by disconnecting master links 301 from the forward and aft chain bolt plates 340, removing rear bolt plate 340 and tailstock 13, and sliding drive component 18 and attached roller chain component 19 off the rear end of chassis beam 12. In the drive screw embodiment, rear plate 13 and tailstock 117 first can be unbolted from drive screw 200 and chassis 12, respectively, such that the back end of both the drive screw and chassis are unencumbered. Then component 18 can be hydraulically unthreaded off the back end of drive screw 200 by manipulation of directional control 420. Reassembly of the directional drill at a job site can follow these same steps in reverse.

Those having ordinary skill in the art will appreciate that the hand-portable directional drills of the present disclosure can be made out of a range of materials that will provide the requisite tensile strength for proper function of the device. It will also be appreciated that compacting the overall length and height of each component can be preferred, as is choosing materials that reduce the overall weight of each component to be carried. High strength aluminum can be a useful material for use where appropriate, due to its light weight. Useful chassis components 11 have an overall length preferably less than 65 inches, more preferably less than 60, or even 55 inches. Useful chassis materials can include 10/18 steel, such as are used in 3" tubing. Wall mount plate 16, which preferably can comprise an integral part of chassis 12, can vary in size and material, provided it can accommodate operational forces typical of directional drills of the size disclosed herein. Such forces typically are in the range of about two tons. Useful materials can include a mild steel, including 10/18 mild steel, or A36 steel. Useful plate dimensions can have lengths and widths in the range of about 10-14 inches, and have a thickness in the range of about 0.25-1.0 inches.

Provided with the present disclosure it is within the skill of the art to fabricate a chassis component 11 that weighs less than about 100 pounds. Useful chassis components 11 can be less than 90 pounds, and can be dimensioned to allow maneuverability when being carried around corners and up and down interior stairs or stairwells.

Similarly, the overall length of a rotary drive unit 18 generally can be less than about 30 inches or less than about 24 inches. Useful units also can have an overall height of less than about 18 inches and a width of less than about 12 inches. Provided with the present disclosure it is within the skill of the art to fabricate a rotary drive unit 18 that weighs less than about 120 pounds. Useful units 18 can weigh less than about 100 pounds, and can be dimensioned to allow ease of maneuverability when being carried around corners and up and down interior stairs or stairwells.

Provided with the instant disclosure, it now is possible to fabricate multi-stage or single stage hand-portable directional drills having an overall weight of less than about 200 pounds and competent to deliver drill strings over a range of at least about 200-250 feet underground with working strengths in the range of about 4,000 pounds and speeds in the range of about 10 ft/minute. Useful hand-portable directional drilling devices according to the present disclosure can have an overall weight of less than about 190 pounds, and even can have an overall weight of less than about 185 pounds.

EXAMPLES

Example 1

One example for setting up and breaking down a hand-portable directional drill 10 now is described. In this example, the drill comprises a roller chain directional drive and is being delivered to a basement interior which is the launch site for directional drilling to a destination access pit outside, typically at a distance in the range of about 70-250 ft away. Chassis component 11, and rotary drive component 18 are independently hand-carried into the building and down any necessary stairs to arrive at the launch site. Using standard equipment, a hole is now or has previously been drilled into the exterior basement wall to access the underground drill bore start site. Chassis component 11 then is lined up to the drill bore start site such that drill bit hole 36 is centered about the drill bore start site. Rear plate 13 with attached tailstock 117 are removed from chassis component 11. Rotary drive component 18 then is slid over the back end of chassis 12 via carriage 20, and rear plate 13 re-attached to chassis component 11. Roller chain master links at the roller chain front and back termini can be attached to roller chain bolt plates 340. Where rear plate 13 comprises an adjustable foot plate, directional drill 10 can be leveled by changing the thread position of pin 64 relative to chassis bolt 74. Wall mount plate 16 can be secured to the basement wall by means of standard concrete bolts 35, such as 0.75-in redhead concrete bolts, drilled through bolt holes 106 on wall plate 33. If desired, wall mount floor plate 31 further can be anchored to the floor by drilling bolts into one or more bolting means 116 that can be provided along the perimeter of plate 31. Similarly, floor plate 14 optionally can be secured to the floor by means of one or more bolts drilled into bolt means 116 that can be provided on the perimeter of the plate.

A desired number of drill stems are provided or have been provided to the launch site. In this example, drill stems are 1-meter length stems with standard male and female joint ends, referred to herein as pin and box ends respectively, and have a bore diameter in the range of about 0.375-inches. A hydraulic power source and pressurized water for drill bit lubrication also are supplied, along with other standard tools and equipment of standard and typical use in directional drilling. If wrench element 85 is not already provided to directional drill 10 e.g., by magnetic connection to wrench stop 96, it is provided now. Drilling now can commence. Once drilling and drill stem retrieval is complete, directional drill 10 easily is disassembled by reversing the steps described above and transporting the components out of the building.

Example 2

In this example, a process for adding drill stems to create a drill string is described using the directional drilling device of the present disclosure. As in the example above, the directional drive comprises a roller chain mechanism.

Example 2A—Process for Providing a Drill Head to Create an Underground Drill Bore Hole An operational drilling device 10 is provided, optionally set up, for example, as described in Example 1 above. Rotary drive component 18 is positioned far enough back on chassis 12 such that a drill head can be attached to stem pipe adapter 32. Wrench flats on the drill bit head are aligned with the flats on adapter 32. Preferably, the drill head comprises an angled blade or bit, means for receiving lubricant from a drill stem central bore, a transmitter or locator beacon (e.g., sonde) component, and an above-ground operator and means are provided for remotely directing the path of the drill head. More preferably, the drill head comprises a debris release cavity 473 at the juncture of drill tip 480 and sonde housing 486 and comprises means for propelling a beam of lubricant across the cavity and into opening 471 of drill tip lubricant channel or captive tunnel 471. Once the drill head is attached to adapter 32, a drill joint 93 is formed. using directional control 420 and drilling is commenced by manipulating directional control 420 to move carriage 20 forward and rotational control 410 to rotate the drill head. Typically, drilling occurs with a clockwise rotation, or with the same rotation that maintains threaded engagement between adapter 32 and a drill stem pin end 53. The drill bit head passes through drill bit hole 36 in wall mount 16 and begins drilling a substantially lateral bore hole through the earth.

The drill head is lubricated throughout the drilling process by means of lubricant, eg., water, provided through port 88 on water coupler housing 86, typically by means of a quick-connect valve 66. Water passes through port 88 into cavity 102 in housing 86 where it accesses the drill stem bore or channel through opening 78 in shaft 76. Once the drill bit head has been fully fed into the drill bore opening, wrench element 85 is released from its storage position on wrench stop 96 and legs or gripping jaws 87 engaged with wrench flats 55. Joint 93 then is cracked open by rotating drill adapter 32 in the counter-clockwise direction by manipulating rotational control 410, and the drill bit head component disengaged from adapter 32 by continued counter-clockwise rotation. Wrench 85 then is returned to a storage position on wrench stop 96. Once adapter 32 is disengaged from the drill head, carriage 20 can be moved back to a stage 0 position, e.g., a starting position to receive a drill stem, by manipulating directional control 420.

Example 2B: Adding a Stem Pipe Section to Build a Drill String

Directional drilling device 10 now is ready to add a stem pipe section to the drill bit head in position in the drill bore hole and begin building drill string 59. Box end 57 of a pipe stem section 51 typically first is threaded onto the exposed pin end of the drill bit head protruding from wall mount drill hole opening 36, forming a stem pipe joint 111. Then pin end 53 of stem pipe 51 is threaded into adapter 32 to form a joint 93, preferably wherein flats on both joint components are aligned forming joint 93. Joint 93 can be formed by moving carriage 20 and its attached rotary drive assembly forward and rotating stem adapter 32 clockwise by manipulating controls 420 and 410, respectively, engaging adapter 32 with pin end 53. Carriage 20 and attached rotary drive component 18 then are moved further forward along chassis 12, feeding pipe stem 51 and drill string 59 into the bore hole, until. adapter/stem pipe joint 93 is at the wall mount plate (referred to herein as "stage 1"), in position with the stem joint wrench breakout system. Wrench element 85 is released from its storage position on wrench stop 96 and legs or jaws 87 are engaged with the wrench flats 55 on the drill stem end. Joint 93 then is cracked open, eg., by rotating drill adapter 32 in the counter-clockwise direction by manipulating rotational control 410, and drill string 59 is disengaged from adapter 32 by continuing the counter-clockwise rotation. Wrench 85 is returned to a storage position on wrench stop 96 and component 18 driven backward along roller chain 300 to a "re-set" stage 0 position to receive another drill stem, by manipulating directional control 420. Directional drilling device 10 now is ready to add additional drill stem sections 51 to the developing drill string by repeating the steps described here in Example 2B.

Example 3

In this example a process for retrieving a drill string is described. As in the examples above, the directional drive mechanism used in this example comprises a roller chain. Once a drill string has been created and a bore hole drilled underground to an intended destination, the drill string is retrieved. Typically the drill head has been drilled to a destination access pit, the drill head removed, and a cable, duct, or pipe attached to the front of the drill string to be threaded back through the bore hole underground as the drill string is retracted. Once the cable, pipe or duct is attached, retrieval of the drill string begins. As will be appreciated by those having ordinary skill in the art, a reamer head could be added to the front of the drill string, before attaching the cable, duct or pipe as desired. In this case, however, a drill bit hole 36 on wall mount 16 would need to be provided having dimensions sufficient to accommodate the reamer head.

Example 3A. Removing the First Stem Pipe Section

To start, component 18 is at the wall mount, with stem adapter 32 forming a joint 93 with pin end 53 of the last stem section 51 in drill string 59. Wrench element 85 is released from its storage position on wrench stop 96. Wrench legs or gripping jaws 87 are engaged with wrench flats 55 on stem section 51. Joint 93 then is cracked open, eg., by rotating drill adapter 32 in the counter-clockwise direction by manipulating directional control 410, and wrench stop slot 97 holds wrench 85 in place, breaking the joint seal. Wrench 85 then is returned to its resting position and collar 34 is moved laterally forward over adapter/stem joint 93, engaging the joint to prevent premature unthreading of the now loosened joint. Carriage 20 then is moved back by manipulating directional control 420, retracting drill string 59 and proximal section 51 out of the bore hole until until it is in the full back "re-set" or stage 0 position. This step completes extraction of the front end of stem pipe section 51 from the bore hole and through drill hole 36, exposing a first stem section joint 111 to be cracked open. Wrench element 85 is released from its storage position on wrench stop 96 and wrench legs or gripping jaws 87 are engaged with wrench flats 55 on the pin end 61 of drill string 59. Newly exposed section joint 111 then is cracked open as described above, ie., by rotating drill adapter 32 in the counter-clockwise direction by manipulating rotational control 410. Collar 34 is moved laterally back off its joint 93 and pipe section 51 is unthreaded from both stem adapter 32 and the pin end 61 of the drill string.

Example 3B. Removing Subsequent Stem Pipe Sections

Carriage 20 now is moved forward by means of directional control 420 until adapter 32 can be threaded onto pin end 61 of the exposed drill string 59 to form a joint 93 with what is now the distal stem in the drill string. As above, threading is performed by manipulating rotational control 410. Collar 34 is moved laterally forward to engage with this new joint 93. Carriage 20 then is moved backward by manipulating directional control 420, retracting drill string 59 and exposing a section 51 out of the bore hole until. i carriage is in the full back "re-set" or stage 0 position. This step completes extraction of the front end of a newly exposed stem pipe section 51 from the bore hole and through drill hole 36, exposing a new stem section joint 111 to be cracked open. Wrench 85 is released from its storage position on wrench stop 96 and wrench legs or gripping jaws 87 are engaged with wrench flats 55 on the pin end 61 of drill string 59. Newly exposed section joint 111 then is cracked open as described above, ie., by rotating drill adapter 32 in the counter-clockwise direction by manipulating rotational control 410. Collar 34 is moved laterally back off its joint 93 and pipe section 51 is unthreaded from both stem adapter 32 and the pin end 61 of the drill string. Subsequent pipe sections 51 can be removed from the drill string by repeating the steps outlined in this Example 3B.

Example 4

One example of a spindle assembly is described. Spindle or shaft 76 can have an overall length in the range of about 5.0-6.5 inches, shaft 76's length being selected to match that of housing 86. Useful outer diameters for shaft 76 can be in the range of about 1.7-2.0 inches and again are selected to accommodate inner cavity 103 dimensions of housing 86. Useful inner spline diameters 75 for shaft 76 accommodate and engage splines 68 of motor 62. Useful such diameters are in the range of about 1.0-1.2 inches. Housing 86 can have an overall outer diameter in the range of about 3.37-4.62 inches, more typically in the range at least about 4.0-4.3 inches. Useful radial wall thicknesses of housing 86 can be in the range of about 0.125-0.25 inches. Optional housing frame 79 provides a means for stabilizing rotary drive unit 24 in frame 118 and has dimensions to accommodate positioning housing 86 in frame 118. Useful frame 79 dimensions can be substantially equal lengths and widths in the range of about 5-6 inches and have a wall thickness in the range of about 0.25-1.0 inches. As illustrated in FIG. 2, housing frame 79 can be stabilized in frame 118 by means of sleeves 117 into which frame 79 fits. A range of suitable housing materials can be used, as will be appreciated in the art. Choosing an aluminum material, particularly a high strength aluminum, provides a housing 86 of substantially low weight. One useful material includes 70/75 aluminum.

Example 5

One example of a drill stem joint wrench system or wrench breakout system is disclosed herein for use with a directional drilling device. As will be appreciated by those having ordinary skill in the art, other configurations and dimensions are within the skill of the art to design and fabricate once provided with the present disclosure. In the example, wrench element 85 has a substantial horseshoe wrench shape, and an overall length in the range of about 6-10 inches, and even 7-9 inches. For application on a 0.75-1.0-inch drill stem pipe flat 55, wrench legs or jaws 87 are in the range of about 3-4 inches, typically in the range of about 1.5-1.7 inches, and have a radius 89 dimensioned for a snug fit; for example in the range of about 0.8 inches, or an overall diameter in the range of about 0.16 inches. Wrench element 85 also has a handle 95 defined by an opening in the wrench body, with dimensions suitable for easy gripping. Useful dimensions include an opening with a length in the range of about 1-3 inches, and a width in the range of about 0.5-2 inches. A wrench stop bracket 96 is integrally mounted to wall mount 16 and extends out from the wall mount in a perpendicular orientation to the wall plate for a distance in the range of about 2-5 inches or even 3-4 inches. Useful widths for stop bracket 96 are in the range of about 4-7 inches, including 5-6 inches. Useful widths are wide enough for easy passage of wrench 85 through the bracket and narrow enough to provide a functional stop for wrench 85 to prevent its rotation about the stem pipe radial axis while breaking open the pipe stem joint. Bracket 96 also includes a crossbar 69 creating slot 97 to minimize movement of wrench 85 along the longitudinal axis of the pipe stem while also acting as rotational stop. In this example, the drill stem joint wrench system is magnetized by means of at least one magnet, typically a rare earth magnet, positioned, for example, on crossbar 69 and of sufficient magnetic strength to removably attach wrench 85 to crossbar 69 when placed in its vicinity. Magnet 98 can be placed on either the front or back face of crossbar 69. In the present example magnet 98 is located substantially at the center of the front face of crossbar 69. A useful magnet is a ⅜-inch N50 rare earth magnet, also known as a neodymium magnet.

Example 6

One example of a magnetized lock nut or wrench collar is described below for application in a directional drilling device. In this example collar 34 has an overall length in the range of about 2.7-3.5 inches, more typically in the range of about 3-inches, and has an outer diameter in the range of about 2.2-2.7 inches. Collar 34's inner diameter has parallel, mutually opposing flats that run the length of the collar and have a width substantially equal to that of the wrench flats on a stem pipe section, typically in the range of 0.7-1.0 inches. At its widest, collar 34's inner diameter generally can be in the range of about 1.70-2.0 inches, more typically in the range of about 1.75-1.85 inches. As will be appreciated by those having ordinary skill in the art, collar 34's inner dimensions provide enough clearance to allow collar 34 to slide on and off a pipe joint 93 and also to fit closely or snugly enough to prevent substantial rotational movement or torquing between the pipe joint members when collar 34 is removably engaged with joint 93. In this example, collar 34 is made of a heat-tempered stainless steel, such as 17/4 stainless steel, and its outer surface is textured, for example by cross-hatching, to enhance gripping during operation. In this example collar 34 also includes 2 magnets on the collar's outer circumference, diametrically opposed, e.g., at 180° to one another, about the collar's circumference. Useful magnets 90 can be ⅜-inch (0.375-inch) N50 magnets, also known as rare earth or neodymium magnets, and magnets of stronger and weaker strength also are contemplated.

Embodiments of this disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes that come within the meaning and range of equivalency of the claims are therefore intended to be embraced therein. While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A hand-portable device suitable for drilling a substantially horizontal bore hole through an underground wall from within a building interior, the device comprising:

(a) a stationary chassis component comprising a wall mount plate and a longitudinal beam extending perpendicular therefrom, said wall mount plate comprising a drill bore aperture and means for attaching said plate to an underground wall contiguous with the ground through which a said bore hole is to be drilled, such that said beam is cantilevered into said building interior when said wall plate is mounted to said wall, and (b) a carriage component removably coupled to said chassis component and competent to move forward and back along said beam between at least two limiting positions, said carriage component comprising a hydraulic rotary drive unit for drilling an attached drill stem through said drill bore aperture;

hydraulic directional movement means for moving said carriage component along said beam between said two limiting positions, and hydraulic valving means for directing rotation of a said attached drill stem and movement of said carriage component along said beam; and (c) wherein said device weighs less than 200 pounds.

2. The hand-portable device of claim 1 wherein said directional drive means comprises a single-stage mechanism for moving said carriage component along said beam.

3. The device of claim 1 wherein said hydraulically powered directional drive means is positioned lateral to said beam's longitudinal axis.

4. The device of claim 1 wherein said hydraulically powered directional drive means is positioned over said beam.

5. The device of claim 1 wherein said beam comprises two parallel opposing beam sections and said hydraulically powered directional drive means is positioned between said sections.

6. The device of claim 1 wherein said coupling means comprises a collar extending out from said carriage component and dimensioned to substantially surround said beam and slide along its length.

7. The device of claim 1 wherein said coupling means comprises a projection extending out from said carriage component and dimensioned to fit in a channel traversing said beam's longitudinal axis such that said carriage component can travel along said beam as said projection travels in said channel.

8. The device of claim 1 wherein said hydraulically powered directional drive means comprises a screw drive.

9. The device of claim 1 wherein said hydraulically powered directional drive means comprises a roller chain drive.

10. The device of claim 9 wherein said roller chain drive comprises a double roller chain.

11. The hand-portable device of claim 1 wherein said device has a thrust strength in the range of at least about 4,000 pounds.

12. The hand-portable device of claim 1 wherein said device has a pull back strength in the range of at least about 4,000 pounds.

13. A method for directional drilling a bore hole underground along an intended path from within a building interior underground, the method comprising the steps of:

(a) providing a bore hole opening in a wall of the building interior underground, said wall being contiguous with the ground through which said bore hole is to be drilled;

(b) hand-carrying a hand-portable directional drilling device to said building interior underground, the device comprising:

(i) a stationary chassis component comprising a wall mount plate and a longitudinal beam extending perpendicular therefrom, said wall mount plate comprising a drill bore aperture and means for attaching said plate to said wall containing said bore hole opening, such that said beam is cantilevered into said building interior when said wall plate is mounted to said wall, and (ii) a carriage component comprising a coupling means dimensioned to pass over the free end of said cantilevered beam and slide along said beam, a hydraulic rotary drive and power unit for rotating an attached drill stem, a hydraulic directional drive and power unit for moving said carriage component along said beam by said coupling means, and a valving unit for directing power to said rotary drive and directional drive units, (c) attaching said wall mount plate to said wall such that said aperture is centered about said bore hole opening;

(d) placing said carriage component at a start position on said cantilevered beam to allow attachment of a drill stem or drill head to said rotary drive unit;

(e) attaching a foot plate to the free end of said cantilevered beam;

(f) attaching a drill head to said rotary drive unit;

(g) providing hydraulic power to said directional drive means to move said carriage component forward along said beam until said carriage component reaches said wall mount plate and said drill head is in said bore hole opening, the back end of said drill head defining the first component of a drill string to be built;

(h) detaching said rotary drive unit from said drill string;

(i) moving said carriage means back along said beam to said start position;

(j) threading a drill stem onto said rotary drive unit;

(k) providing hydraulic power to said directional drive means to move said carriage component forward along said beam until the free front end of said drill stem reaches said drill string;

(l) providing hydraulic power to said rotary drive unit to thread said drill stem on said drill string;

(m) providing hydraulic power to said directional drive component until said carriage component reaches said wall mount plate and said drill stem is in said bore hole opening, the back end of said drill stem defining the next component of a drill string to be built;

(n) repeating steps (h)-(m) until said bore hole is complete.

14. The method of claim 13 wherein said directional drive means comprises a roller chain drive.

15. The method of claim 13 wherein said directional drive means comprises a screw drive.

* * * * *